US008529251B2

(12) United States Patent
Kumagai et al.

(10) Patent No.: US 8,529,251 B2
(45) Date of Patent: Sep. 10, 2013

(54) ROTARY KILN AND PRODUCT

(75) Inventors: Hiroki Kumagai, Toki (JP); Fumihiko Kato, Toki (JP); Sadahiko Kawasaki, Toki (JP)

(73) Assignee: Takasago Industry Co., Ltd., Toki (JP)

( * ) Notice: Subject to any disclaimer, the term of this patent is extended or adjusted under 35 U.S.C. 154(b) by 531 days.

(21) Appl. No.: 12/842,594

(22) Filed: Jul. 23, 2010

(65) Prior Publication Data

US 2011/0065058 A1 Mar. 17, 2011

(30) Foreign Application Priority Data

Sep. 14, 2009 (JP) ..... 2009-212478
Jun. 3, 2010 (JP) ..... 2010-127748

(51) Int. Cl.

| | |
|---|---|
| ***F27B 7/08*** | (2006.01) |
| ***F27B 7/36*** | (2006.01) |
| ***F27B 7/22*** | (2006.01) |
| ***F27B 7/38*** | (2006.01) |

(52) U.S. Cl.
USPC ..... 432/112; 432/233; 432/113

(58) Field of Classification Search
USPC ..... 432/112–113, 111–118, 103–110, 432/233
See application file for complete search history.

(56) References Cited

U.S. PATENT DOCUMENTS

| | | | | |
|---|---|---|---|---|
| 4,131,418 | A * | 12/1978 | Kramm et al. | 432/80 |
| 4,207,062 | A * | 6/1980 | Moench et al. | 432/111 |
| 4,474,524 | A * | 10/1984 | Kawakami et al. | 414/213 |
| 4,813,784 | A * | 3/1989 | Musil | 366/24 |
| 4,988,289 | A * | 1/1991 | Coucher | 432/103 |
| 5,083,870 | A * | 1/1992 | Sindelar et al. | 366/25 |
| 5,207,009 | A * | 5/1993 | Thompson et al. | 34/135 |
| 5,294,062 | A * | 3/1994 | Hendrickson et al. | 241/67 |
| 5,769,007 | A * | 6/1998 | Tratz et al. | 110/246 |
| 6,027,338 | A * | 2/2000 | Okinaka et al. | 432/103 |
| 6,042,370 | A * | 3/2000 | Weide | 432/103 |
| 6,244,859 | B1 * | 6/2001 | Ragailler | 432/103 |
| 6,901,868 | B2 * | 6/2005 | Hornung et al. | 110/246 |
| 2004/0115582 | A1 * | 6/2004 | Hansen et al. | 432/113 |
| 2008/0210538 | A1 * | 9/2008 | Clark | 202/131 |
| 2011/0065005 | A1 * | 3/2011 | Kumagai et al. | 429/231.8 |

FOREIGN PATENT DOCUMENTS

| | | | |
|---|---|---|---|
| EP | 252292 | A2 * | 1/1988 |
| JP | 2008-128492 | | 6/2008 |
| WO | WO 9202773 | A * | 2/1992 |

OTHER PUBLICATIONS

U.S. Appl. No. 12/842,582, filed Jul. 23, 2010, Kumagai, et al.

* cited by examiner

*Primary Examiner* — Kang Hu
*Assistant Examiner* — Nathaniel Herzfeld
(74) *Attorney, Agent, or Firm* — Oblon, Spivak, McClelland, Maier & Neustadt, L.L.P.

(57) ABSTRACT

A rotary kiln includes: a cylindrical shell that includes a supply-side end portion and a discharge-side end portion at both ends in an axial direction of the shell, and a heat treatment chamber which is defined inside the shell and in which a heat treatment is performed on a process material; a supply-side holder that holds the supply-side end portion; a discharge-side holder that holds the discharge-side end portion; a supply-side rotary shaft that allows rotation of the supply-side holder; and a discharge-side rotary shaft that allows rotation of the discharge-side holder. The shell is rotated about its own axis by rotating at least one of the supply-side rotary shaft and the discharge-side rotary shaft.

20 Claims, 14 Drawing Sheets

ROTARY KILN AND PRODUCT

INCORPORATION BY REFERENCE

The disclosure of Japanese Patent Application No. 2009-212478 filed on Sep. 14, 2009 including the specification, drawings and abstract is incorporated herein by reference in its entirety. The disclosure of Japanese Patent Application No. 2010-127748 filed on Jun. 3, 2010 including the specification, drawings and abstract is incorporated herein by reference in its entirety.

BACKGROUND OF THE INVENTION

1. Field of the Invention

The present invention relates to a rotary kiln that performs a heat treatment on a process material while transferring the process material in an axial direction, and to a product manufactured by the rotary kiln.

2. Description of the Related Art

A rotary kiln includes a shell that rotates about its own axis (see Japanese Patent Application Publication No. 2008-128492 (JP-A-2008-128492), for example). FIG. 14 is a perspective view of a rotary kiln disclosed in JP-A-2008-128492. As shown in FIG. 14, a rotary kiln 100 includes a shell 101, a heating section 102, and a platform 103. A pair of front and rear rollers 103*a* is disposed on the left side of the upper surface of the platform 103. Also, a pair of front and rear rollers 103*b* is disposed on the right side of the upper surface of the platform 103. A pair of left and right tires 101*a* and 101*b* is disposed on the outer peripheral surface of the shell 101. A gear 101*c* is disposed on the right side of the tire 101*b*. The heating section 102 covers the body portion of the shell 101.

The tire 101*a* is placed on the pair of rollers 103*a*. Also, the tire 101*b* is placed on the pair of rollers 103*b*. When a rotational force is applied to the gear 101*c*, the tire 101*a* rolls on the pair of rollers 103*a*. Also, the tire 101*b* rolls on the pair of rollers 103*b*. This allows the shell 101 to rotate about its own axis.

A process material is transferred inside the rotating shell 101 from the right side (supply side) to the left side (discharge side). At this time, the process material is heated by heat of the heating section 102. In this way, the rotary kiln 100 performs a heat treatment on the process material.

In the case of the rotary kiln 100 according to the related art, it is necessary to mount the tires 101*a* and 101*b* on the outer peripheral surface of the shell 101 in order to allow rotation of the shell 101 while securely supporting a rotation axis thereof. In addition, it is necessary to mount the gear 101*c* on the outer peripheral surface of the shell 101 in order to transmit a rotational force.

Depending on the material of the shell 101, however, it may be difficult to mount these members on the outer peripheral surface of the shell 101. For example, in the case where the shell 101 is made of a ceramic and the tires 101*a* and 101*b* and the gear 101*c* are made of a metal, it is necessary to mount the members on the outer peripheral surface of the shell 101 by tightening the members on the shell 101. In this case, if the tightening force is loose, the members may slip with respect to the shell 101. On the contrary, if the tightening force is large, the force that compresses the shell 101 from the radially outer side to the radially inner side may be strong. Thus, it may be difficult to mount the tires 101*a* and 101*b* and the gear 101*c* depending on the material of the shell 101. Thus, the rotary kiln according to the related art has low versatility for the material of the shell.

The shell 101 is designed to have a diameter set in accordance with the amount of production and the characteristics of the process material. For example, in the case where the amount of production of the process material is set to be much, the shell 101 is designed to have a large diameter. On the contrary, in the case where the amount of production of the process material is set to be little, the shell 101 is designed to have a small diameter.

In the case of the rotary kiln 100 according to the related art, however, a change in diameter of the shell 101 involves a change in dimensions of the tires 101*a* and 101*b*, the gear 101*c*, the rollers 103*a* and 103*b*, and so forth. For example, an increase in diameter of the shell 101 involves an increase in diameter of the tires 101*a* and 101*b* and the gear 101*c*. An increase in diameter of the shell 101 also involves an increase in interval between the pair of rollers 103*a* and interval between the pair of rollers 103*b*. On the contrary, a decrease in diameter of the shell 101 involves a decrease in diameter of the tires 101*a* and 101*b* and the gear 101*c*. A decrease in diameter of the shell 101 also involves a decrease in interval between the pair of rollers 103*a* and interval between the pair of rollers 103*b*. Thus, the rotary kiln 100 according to the related art has low versatility for the diameter of the shell 101.

SUMMARY OF THE INVENTION

The rotary kiln according to the present invention has been completed in view of the aforementioned issues. It is an object of the present invention to provide a rotary kiln with high versatility for the material and the diameter of a shell. It is another object of the present invention to provide a product manufactured by the rotary kiln.

(1) In order to address the aforementioned issues, a first aspect of the present invention provides a rotary kiln including: a cylindrical shell that includes a supply-side end portion and a discharge-side end portion at both ends in an axial direction of the shell, and a heat treatment chamber which is defined inside the shell and in which a heat treatment is performed on a process material; a supply-side holder that holds the supply-side end portion; a discharge-side holder that holds the discharge-side end portion; a supply-side rotary shaft that allows rotation of the supply-side holder; and a discharge-side rotary shaft that allows rotation of the discharge-side holder, in which the shell is rotated about an axis thereof by rotating at least one of the supply-side rotary shaft and the discharge-side rotary shaft.

According to the rotary kiln of the present invention, the supply-side rotary shaft and the discharge-side rotary shaft allow rotation of the shell while securely supporting a rotation axis thereof. A rotational force is transmitted to the shell from at least one of the supply-side rotary shaft and the discharge-side rotary shaft. Therefore, it is not necessary to dispose a member that allows rotation of the shell while securely supporting the rotation axis thereof (for example, the tires 101*a*, 101*b* in FIG. 14) or a member that transmits a rotational force (for example, the gear 101*c* in FIG. 14) on the outer peripheral surface of the shell. Thus, the shell can be rotated with the rotation axis thereof being securely supported regardless of the material of the shell. In addition, a rotational force can be transmitted to the shell regardless of the material of the shell. Thus, the rotary kiln according to the present invention provides high versatility for the material of the shell.

Also, according to the rotary kiln of the present invention, it is only necessary to change the supply-side holder and the discharge-side holder in order to change the diameter of the shell. That is, it is not necessary to change the supply-side rotary shaft and the discharge-side rotary shaft. Therefore, the rotary kiln according to the present invention provides high versatility for the diameter of the shell.

(2) According to a second aspect of the present invention, in the aforementioned configuration (1), it is preferable that the supply-side holder and the discharge-side holder are attached to the shell so as to be removable in the axial direction. According to this configuration, the shell can be removed from the supply-side holder and the discharge-side holder. This is convenient for inspection, repair, replacement, and so forth of the shell.

(3) According to a third aspect of the present invention, in the aforementioned configuration (2), it is preferable that the rotary kiln further includes: a supply-side support cart that includes the supply-side holder, the supply-side rotary shaft, and a bearing portion which rotatably supports the supply-side rotary shaft, and that is movable in the axial direction; and a discharge-side support cart that includes the discharge-side holder, the discharge-side rotary shaft, and a bearing portion which rotatably supports the discharge-side rotary shaft, and that is movable in the axial direction.

According to this configuration, the supply-side holder and the supply-side rotary shaft are disposed on the supply-side support cart. Also, the discharge-side holder and the discharge-side rotary shaft are disposed on the discharge-side support cart. Therefore, the supply-side holder and the discharge-side holder are easily movable. That is, the supply-side holder and the discharge-side holder can be easily attached to and removed from the shell.

(4) According to a fourth aspect of the present invention, in the aforementioned configuration (3), it is preferable that the supply-side rotary shaft is inserted into the shell from the supply-side end portion, and the rotary kiln further includes a supply part cart that includes a supply section inserted into the supply-side rotary shaft to supply the process material into the heat treatment chamber, and that is movable in the axial direction.

According to this configuration, the process material can be easily supplied into the shell. Moreover, the starting point of the heat treatment chamber can be located in the vicinity of the supply-side end portion. That is, the overall length of the heat treatment chamber in the axial direction can be set to be long. Also, according to this configuration, the supply section is disposed on the supply part cart. Therefore, the supply section is easily movable. That is, the supply section can be easily inserted into and taken out of the supply-side rotary shaft. This is convenient for inspection, repair, replacement, and so forth of the supply section.

(5) According to a fifth aspect of the present invention, in any one of the aforementioned configurations (2) to (4), it is preferable that the rotary kiln further includes a heating section that includes a heating chamber which is defined inside the heating section and through which the shell penetrates, and that is dividable along the shell.

This configuration provides a so-called externally heated rotary kiln. According to this configuration, a portion of the shell that is housed in the heating section can be exposed easily. This is convenient for inspection, repair, replacement, and so forth of the shell. This also allows access to the shell from a radial direction during replacement of the shell. This facilitates replacement work.

(5-1) In the aforementioned configuration (5), it is preferable that the heating section includes a lower divided portion and an upper divided portion that can be opened and closed to the lower divided portion, and a lower half portion and an upper half portion of the shell are respectively housed in the lower divided portion and the upper divided portion.

According to this configuration, the upper half portion of the shell is exposed by opening the upper divided portion. This is convenient for inspection, repair, replacement, and so forth of the shell. This also allows access to the shell from above during replacement of the shell. This facilitates replacement work.

(6) According to a sixth aspect of the present invention, in any one of the aforementioned configurations (1) to (5), it is preferable that the shell includes a supply-side heat insulation portion disposed radially inward of the supply-side end portion and a discharge-side heat insulation portion disposed radially inward of the discharge-side end portion.

According to this configuration, heat of the heat treatment chamber is not easily transmitted to the supply-side rotary shaft and the discharge-side rotary shaft. Therefore, a failure due to heat is not likely to occur in the supply-side rotary shaft and the discharge-side rotary shaft. Also, since heat is not easily transmitted to the supply-side rotary shaft and the discharge-side rotary shaft, the overall length of the heat treatment chamber in the axial direction can be set to be long.

(7) According to a seventh aspect of the present invention, in any one of the aforementioned configurations (1) to (6), it is preferable that the rotary kiln further includes a cooling section disposed inside the discharge-side rotary shaft to cool the discharge-side rotary shaft.

According to this configuration, the discharge-side rotary shaft can be cooled. Therefore, a failure due to heat is not likely to occur in the discharge-side rotary shaft. Also, since the temperature of the discharge-side rotary shaft is not likely to rise, the overall length of the heat treatment chamber in the axial direction can be set to be long.

(8) According to an eighth aspect of the present invention, in any one of the aforementioned configurations (1) to (7), it is preferable that the rotary kiln further includes a common drive section that transmits a drive force to the supply-side rotary shaft and the discharge-side rotary shaft.

According to this configuration, the number of parts is reduced compared to a case where a drive section exclusively for the supply-side rotary shaft and a drive section exclusively for the discharge-side rotary shaft are provided separately. Also, the drive section requires only a small installation space. Moreover, according to this configuration, it is easier to match the rotational speed of the supply-side rotary shaft and the rotational speed of the discharge-side rotary shaft with each other.

(9) According to a ninth aspect of the present invention, in any one of the aforementioned configurations (1) to (8), it is preferable that of a set of the supply-side holder and the supply-side end portion and a set of the discharge-side holder and the discharge-side end portion, one set of the holder and the end portion is coupled to each other so as not to be rotatable relative to each other, and the other set of the holder and the end portion is coupled so as to be rotatable relative to each other. According to this configuration, a torsional force is not likely to be applied to the shell even in the case where the rotational speed of the supply-side rotary shaft and the rotational speed of the discharge-side rotary shaft are different from each other.

(10) According to a tenth aspect of the present invention, in any one of the aforementioned configurations (1) to (9), it is preferable that the rotary kiln further includes a gas supply section that supplies an ambient gas to a space radially inward of the shell and a space radially outward of the shell.

According to this configuration, an ambient gas can be supplied in accordance with the characteristics of the process material and the material of the shell. In particular, combining this configuration and any one of the aforementioned configurations (2) to (5) facilitates replacement of the shell, so that the kind of the ambient gas can be changed in accordance with a change of the shell. In this way, this configuration allows the common use of the rotary kiln for a plurality of types of process materials and shells.

(11) According to an eleventh aspect of the present invention, in any one of the aforementioned configurations (1) to (10), it is preferable that the shell is made of carbon, and a battery material is manufactured by performing a heat treatment on the process material.

According to this configuration, the shell is made of carbon. Therefore, contamination of metal scale, which adversely affects the battery material, into the battery material can be suppressed. Thus, degradation in performance of the battery material can be suppressed. Also, the shell made of carbon provides excellent processability. Moreover, the shell made of carbon provides excellent heat shock resistance.

(12) In order to address the aforementioned issues, a twelfth aspect of the present invention provides a product manufactured by performing a heat treatment on the process material in the rotary kiln according to any one of the aforementioned configurations (1) to (10).

The product according to the present invention is manufactured by the rotary kiln according to the present invention. The rotary kiln according to the present invention provides high versatility for the material of the shell. Therefore, the material of the shell can be selected in accordance with the type of the product. Thus, it is possible to manufacture a desired product without using the shell which contains a component, contamination of which into the product is not preferable. For example, in the case where the product is a battery material, contamination of metal scale into the battery material is not preferable. In this case, contamination of metal scale into the battery material can be suppressed by using a shell made of a non-metallic material (for example, made of carbon).

According to the present invention, it is possible to provide a rotary kiln with high versatility for the material and the diameter of a shell. It is also possible to provide a product manufactured by the rotary kiln.

DETAILED DESCRIPTION OF THE EMBODIMENTS

A rotary kiln and a product according to an embodiment of the present invention will be described below.

<Configuration of Rotary Kiln>

Figure 1:
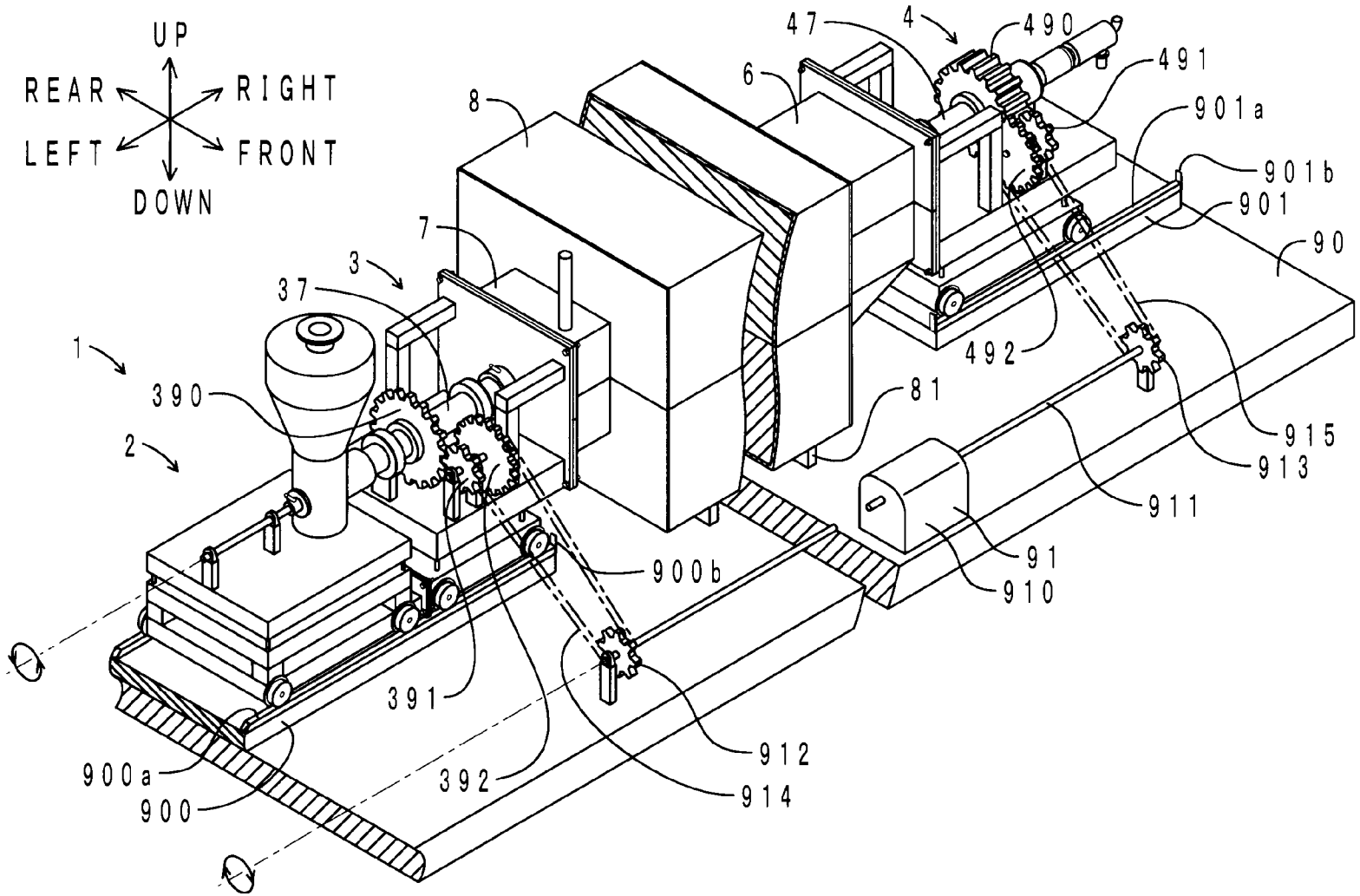
FIG. 1 is a perspective view of a rotary kiln according to an embodiment of the present invention.
Figure 2:
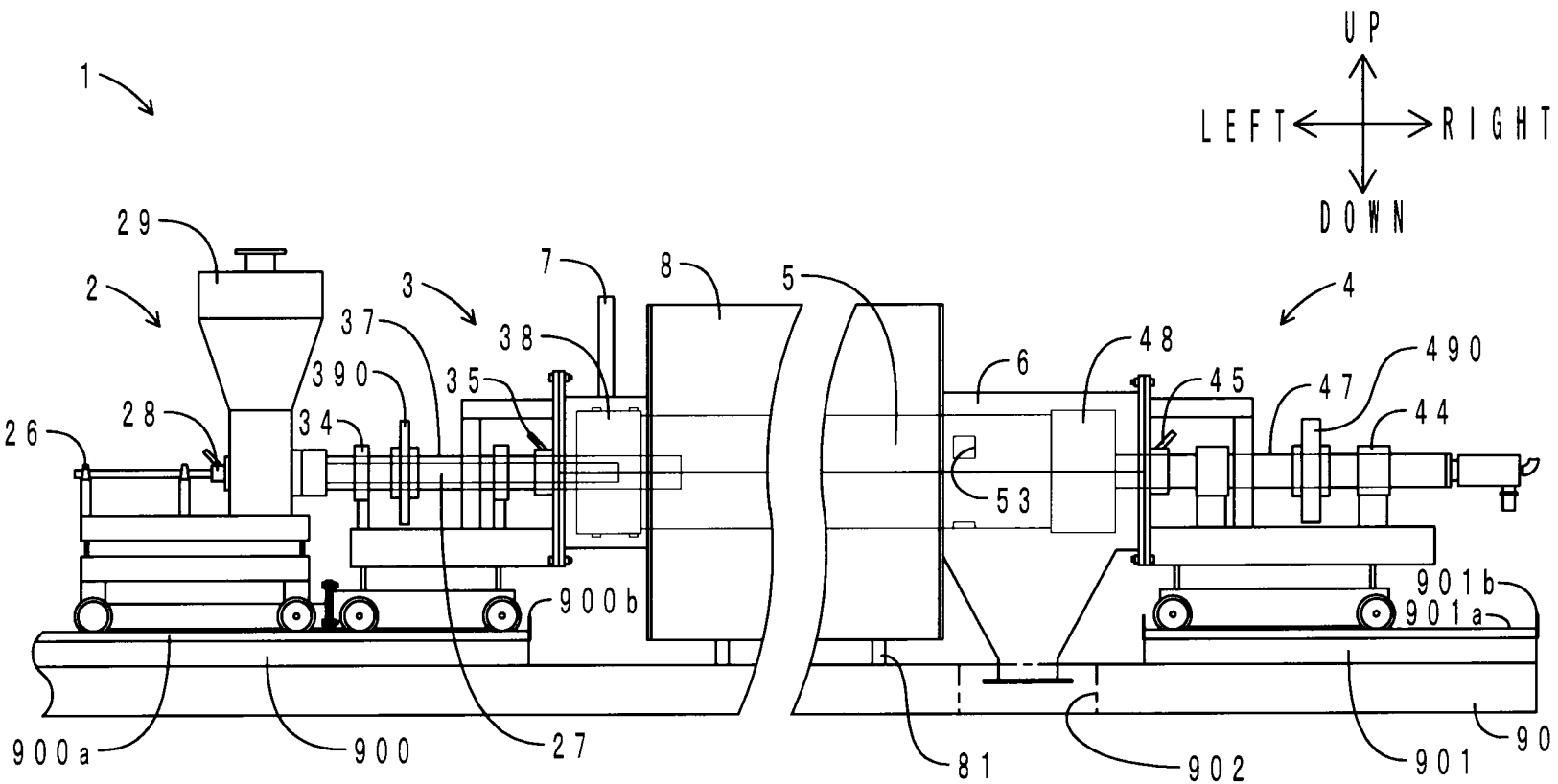
FIG. 2 is a transparent front view of the rotary kiln.

First, the configuration of the rotary kiln according to the embodiment is described. In the drawings, the left side corresponds to the supply side (upstream side), and the right side corresponds to the discharge side (downstream side). For convenience of description, three fins 56 of a shell 5 are not shown in drawings other than FIG. 10. FIG. 1 is a perspective view of the rotary kiln according to the embodiment. FIG. 2 is a transparent front view of the rotary kiln.

As shown in FIGS. 1 and 2, a rotary kiln 1 according to the embodiment includes a supply part cart 2, a supply-side support cart 3, a discharge-side support cart 4, the shell 5, a discharge chute 6, a supply-side coupling tubular portion 7, a heating section 8, a platform 90, and a drive section 91.

[Platform 90]

The platform 90 has the shape of a plate. The platform 90 is placed on a site of a plant. The platform 90 includes a supply-side track portion 900, a discharge-side track portion 901, and a product extraction hole 902. As shown in FIG. 2, the product extraction hole 902 is drilled in the platform 90. The supply-side track portion 900 includes a pair of rails 900*a*. The rails 900*a* are made of steel, and extend in the left-right direction. Stoppers 900*b* are respectively disposed at both ends of the rails 900*a* in the left-right direction. The discharge-side track portion 901 includes a pair of rails 901*a*. The rails 901*a* are made of steel, and extend in the left-right direction. Stoppers 901*b* are respectively disposed at both ends of the rails 901*a* in the left-right direction.

[Drive Section 91]

As shown in FIG. 1, the drive section 91 includes a motor 910, a shaft 911, a supply-side drive sprocket 912, and a discharge-side drive sprocket 913. The motor 910 is disposed on the upper surface of the platform 90. The shaft 911 is coupled to a rotary shaft of the motor 910. The supply-side drive sprocket 912 is fixed at the left end of the shaft 911. The discharge-side drive sprocket 913 is fixed at the right end of the shaft 911.

[Supply Part Cart 2]

Figure 3:
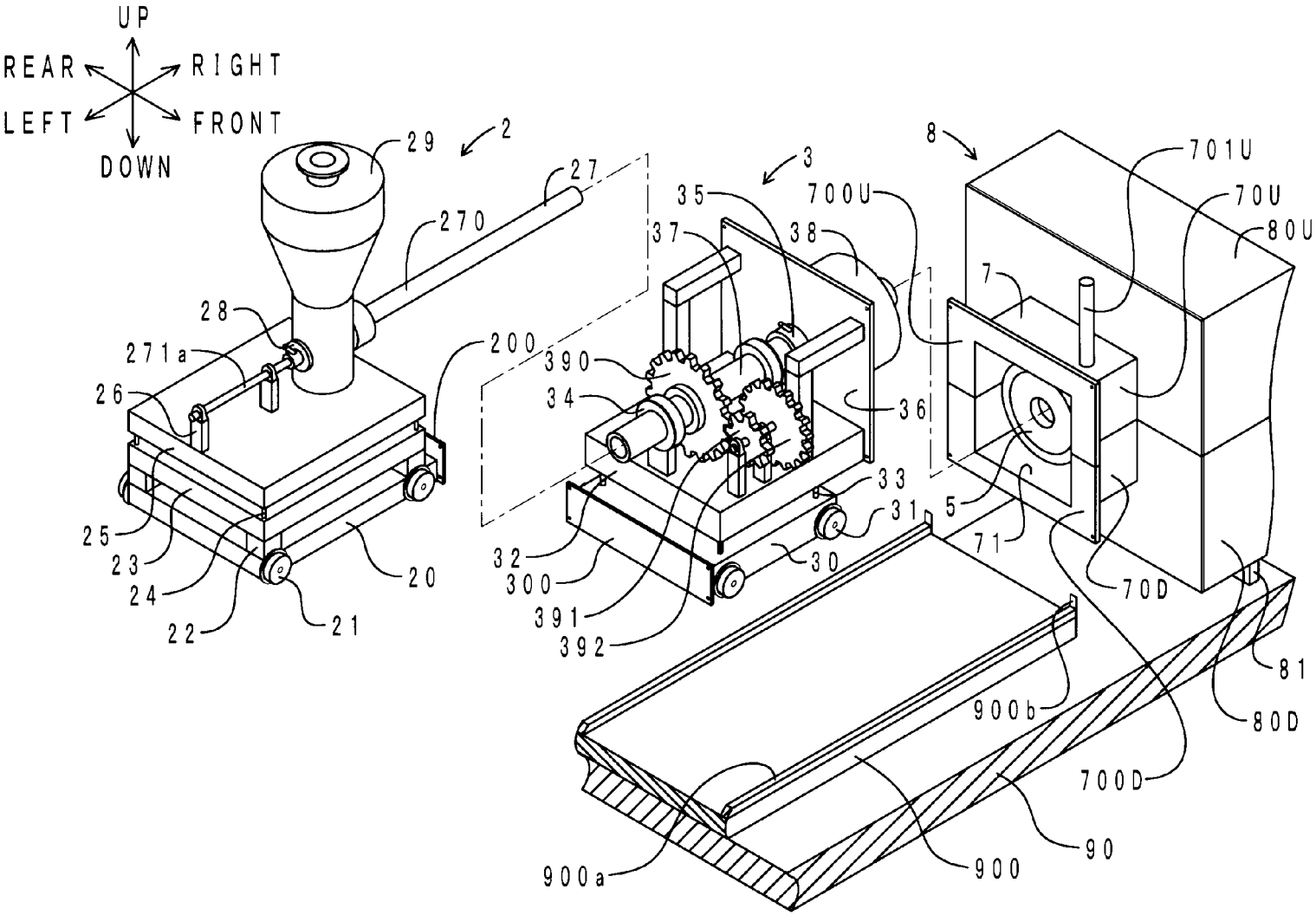
FIG. 3 is an exploded perspective view of a left portion of the rotary kiln.
Figure 4:
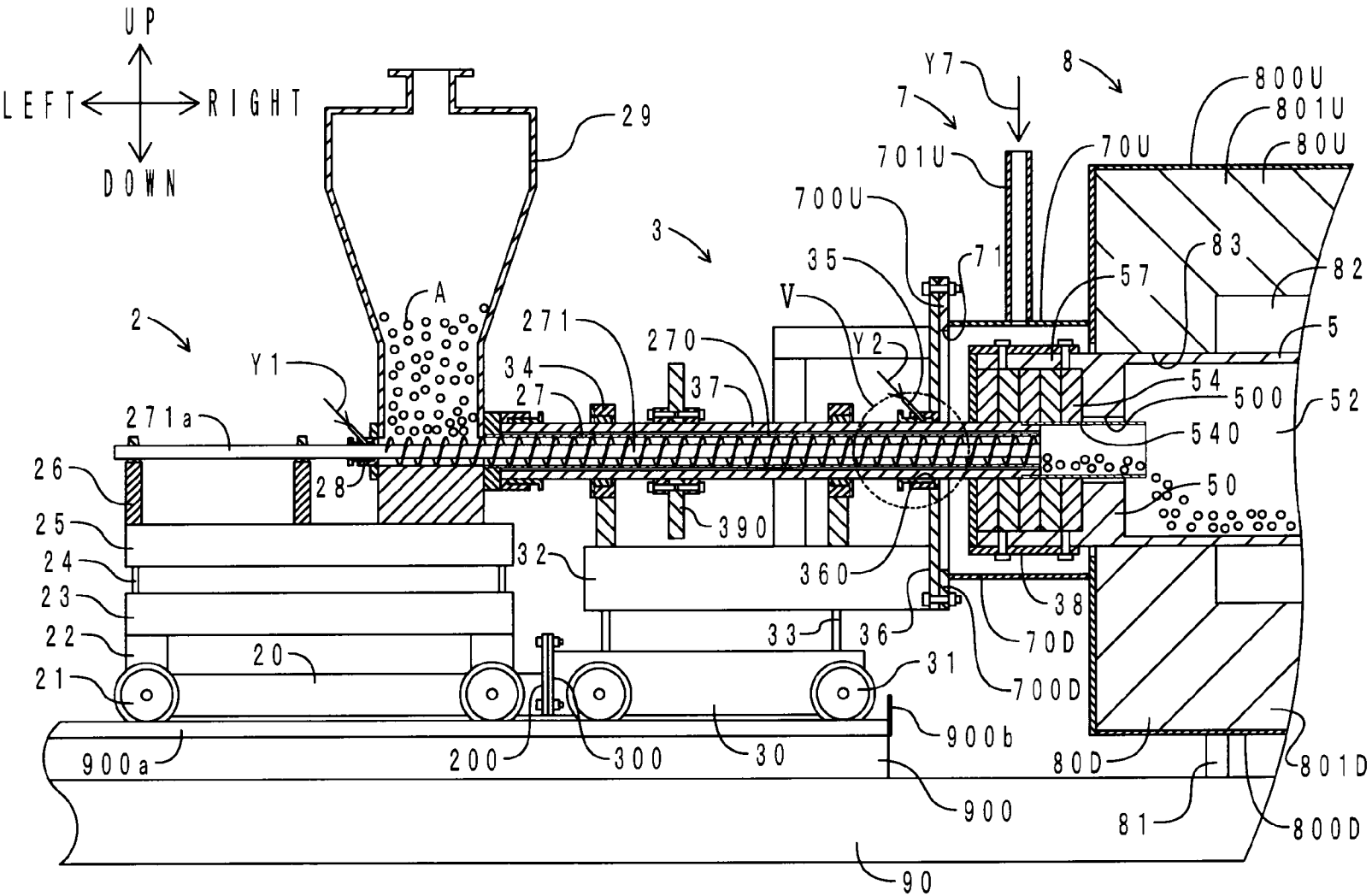
FIG. 4 is a cross-sectional view of the left portion taken in the left-right direction.

FIG. 3 is an exploded perspective view of a left portion of the rotary kiln according to the embodiment. FIG. 4 is a cross-sectional view of the left portion taken in the left-right direction. As shown in FIGS. 3 and 4, the supply part cart 2 includes a lower stage portion 20, four wheels 21, four coupling pillars 22, a middle stage portion 23, four coupling rods 24, an upper stage portion 25, a pair of bearing portions 26, a screw feeder 27, a sealing portion 28, and a supply hopper 29. The screw feeder 27 is included in the supply section according to the present invention. The sealing portion 28 is included in the gas supply section according to the present invention.

The lower stage portion 20 is made of steel, and has the shape of a rectangular plate. A coupling plate 200 is disposed at the right end of the lower stage portion 20. The four wheels 21 are disposed in the vicinity of the four corners of the lower stage portion 20. The four wheels 21 can roll in the left-right direction on the pair of rails 900*a*. That is, the supply part cart 2 is movable in the left-right direction along the pair of rails 900*a*.

The middle stage portion 23 is made of steel, and has the shape of a rectangular plate. The middle stage portion 23 is disposed above the lower stage portion 20. Each of the four coupling pillars 22 has the shape of a rectangular column. The four coupling pillars 22 are interposed between the lower stage portion 20 and the middle stage portion 23.

The upper stage portion 25 is made of steel, and has the shape of a rectangular plate. The upper stage portion 25 is disposed above the middle stage portion 23. Each of the four coupling rods 24 has the shape of a round bar. The four coupling rods 24 are interposed between the middle stage portion 23 and the upper stage portion 25.

The pair of bearing portions 26 is disposed on the upper surface of the upper stage portion 25. The pair of bearing portions 26 is arranged in the left-right direction at a predetermined interval between each other. The supply hopper 29 is made of steel, and has the shape of a cone tapered downward. The supply hopper 29 is disposed on the upper surface of the upper stage portion 25. The supply hopper 29 is disposed on the right side of the pair of bearing portions 26. A process material A is stored in the supply hopper 29.

The screw feeder 27 includes a screw-housing cylindrical portion 270 and a screw 271. The screw-housing cylindrical portion 270 is made of steel, and has the shape of a cylinder. The screw-housing cylindrical portion 270 is projected rightward from the lower end of the supply hopper 29. The screw 271 is housed in the screw-housing cylindrical portion 270. The screw 271 is driven by a drive force of a motor (not shown) to rotate about its own axis. A shaft portion 271*a* of the screw 271 penetrates through the left wall of the supply hopper 29. The penetrating end of the shaft portion 271*a* is supported by the pair of bearing portions 26 so as to be rotatable about its own axis.

The sealing portion 28 is interposed between the left wall of the supply hopper 29 and the shaft portion 271*a* of the screw 271. The sealing portion 28 seals a gap between the left wall of the supply hopper 29 and the shaft portion 271*a* while permitting turning of the shaft portion 271*a*. The configuration of the sealing portion 28 is the same as the configuration of a sealing portion 35 of the supply-side support cart 3 to be discussed later (see FIG. 5). A nitrogen gas is supplied from the sealing portion 28 as indicated by an arrow Y1. The nitrogen gas is included in the ambient gas according to the present invention. The nitrogen gas is diffused inside the supply hopper 29 and inside the screw-housing cylindrical portion 270.

[Supply-Side Support Cart 3]

The supply-side support cart 3 includes a lower stage portion 30, four wheels 31, an upper stage portion 32, four coupling rods 33, a pair of bearing portions 34, the sealing portion 35, a coupling plate 36, a supply-side rotary shaft 37, a supply-side holder 38, a supply-side gear 390, a supply-side pinion 391, and a supply-side sprocket 392. The sealing portion 35 is included in the gas supply section according to the present invention.

The lower stage portion 30 is made of steel, and has the shape of a rectangular plate. A coupling plate 300 is disposed at the left end of the lower stage portion 30. The coupling plate 300 can be coupled to the coupling plate 200 via a bolt-nut mechanism. That is, the supply-side support cart 3 and the supply part cart 2 can be coupled to each other. The four wheels 31 are disposed in the vicinity of the four corners of the lower stage portion 30. The four wheels 31 can roll in the left-right direction on the pair of rails 900*a*. That is, the supply-side support cart 3 is movable in the left-right direction along the pair of rails 900*a*.

The upper stage portion 32 is made of steel, and has the shape of a rectangular plate. The upper stage portion 32 is disposed above the lower stage portion 30. Each of the four coupling rods 33 has the shape of a round bar. The four coupling rods 33 are interposed between the lower stage portion 30 and the upper stage portion 32.

The pair of bearing portions 34 is disposed on the upper surface of the upper stage portion 32. The pair of bearing portions 34 is arranged in the left-right direction at a predetermined interval between each other. The coupling plate 36 is made of steel, and has the shape of a rectangular plate. The coupling plate 36 is disposed at the right end of the upper stage portion 32. A supply-side rotary shaft insertion hole 360 is drilled in the coupling plate 36. The supply-side rotary shaft 37 is made of steel, and has the shape of a cylinder. The supply-side rotary shaft 37 is supported by the pair of bearing portions 34 so as to be rotatable about its own axis. The right end of the supply-side rotary shaft 37 is inserted into the supply-side rotary shaft insertion hole 360.

Figure 5:
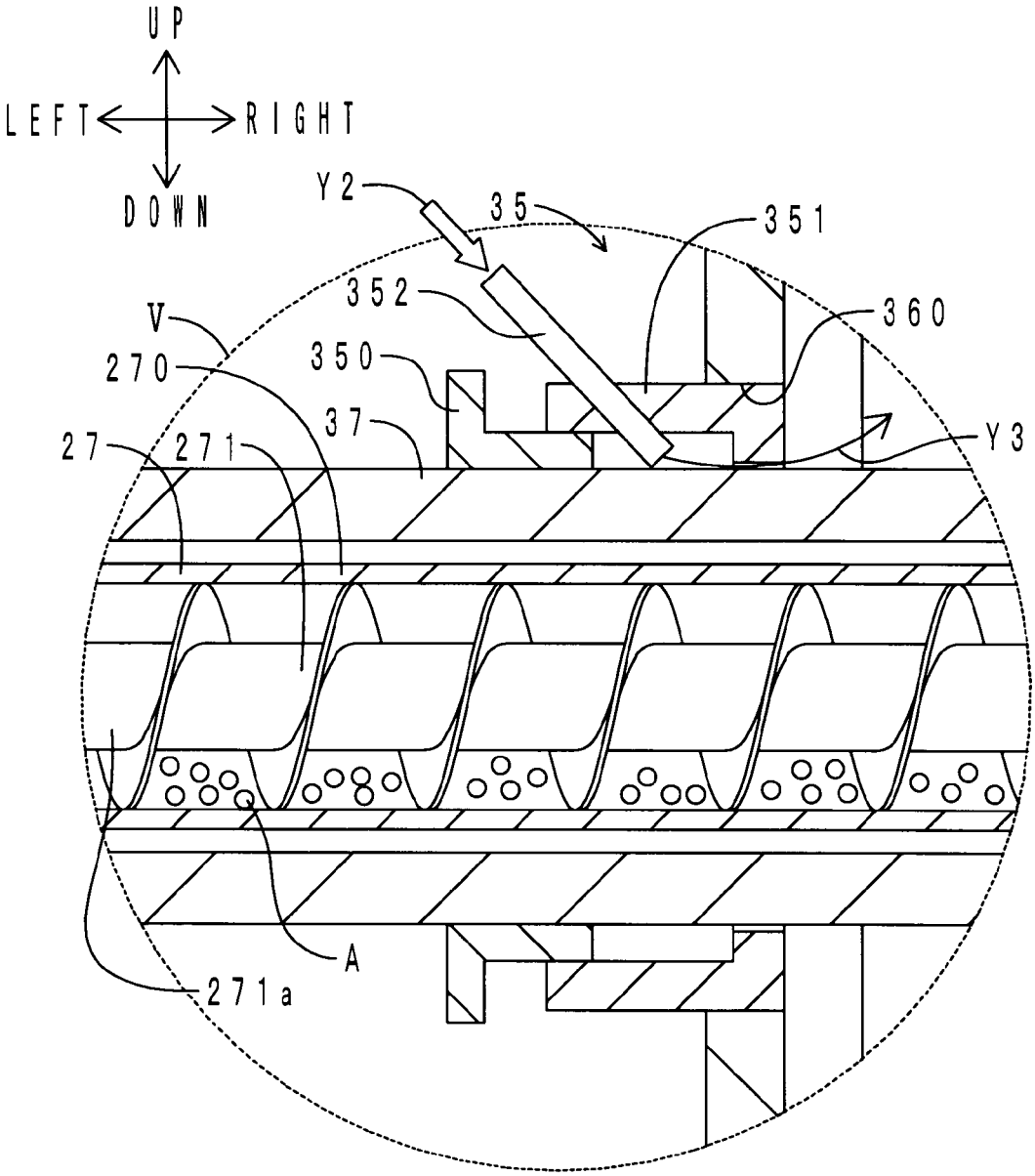
FIG. 5 is an enlarged view of a portion inside a circle V of FIG. 4.

FIG. 5 is an enlarged view of a portion inside a circle V of FIG. 4. As shown in FIG. 5, the sealing portion 35 is interposed between the supply-side rotary shaft 37 and the supply-side rotary shaft insertion hole 360. The sealing portion 35 includes an inner annular portion 350, an outer annular portion 351, and a gas pipe 352. The outer annular portion 351 is made of SUS (Stainless Used Steel) 304, and has the shape of a bottomed cylinder (cup) opening leftward. The supply-side rotary shaft 37 is inserted through the right bottom wall of the outer annular portion 351. The side peripheral wall of the outer annular portion 351 is fixed to the inner peripheral surface of the supply-side rotary shaft insertion hole 360. The inner annular portion 350 is made of SUS 304, and has the shape of a ring. The inner annular portion 350 seals the left opening of the outer annular portion 351. The inner annular portion 350 is fixed to the outer annular portion 351. The gas pipe 352 penetrates through the side peripheral wall of the outer annular portion 351. A nitrogen gas is supplied from the gas pipe 352 to a space radially inward of the outer annular portion 351 as indicated by an arrow Y2. The nitrogen gas is diffused inside the supply-side coupling tubular portion 7 to be discussed later as indicated by an arrow Y3.

Returning to FIGS. 3 and 4, the supply-side holder 38 is made of steel, and has the shape of a bottomed cylinder (cup) opening rightward. The supply-side holder 38 is disposed on the right side of the coupling plate 36. The supply-side rotary shaft 37 penetrates through the radially inner side of the supply-side holder 38. The supply-side holder 38 is fixed to the outer peripheral surface at the right end of the supply-side rotary shaft 37.

The supply-side gear 390 is made of steel, and has the shape of a circular plate. The supply-side gear 390 is fixed to the outer peripheral surface of the supply-side rotary shaft 37. The supply-side gear 390 is disposed between the pair of bearing portions 34. The supply-side pinion 391 is made of steel, and has the shape of a circular plate. The supply-side pinion 391 is meshed with the supply-side gear 390. The supply-side sprocket 392 is made of steel, and has the shape of a circular plate. The supply-side sprocket 392 and the supply-side pinion 391 are fixed to an identical shaft. As indicated by dash-dotted lines in FIG. 1, a chain 914 is wound between the supply-side sprocket 392 and the supply-side drive sprocket 912.

[Discharge-Side Support Cart 4]

Figure 6:
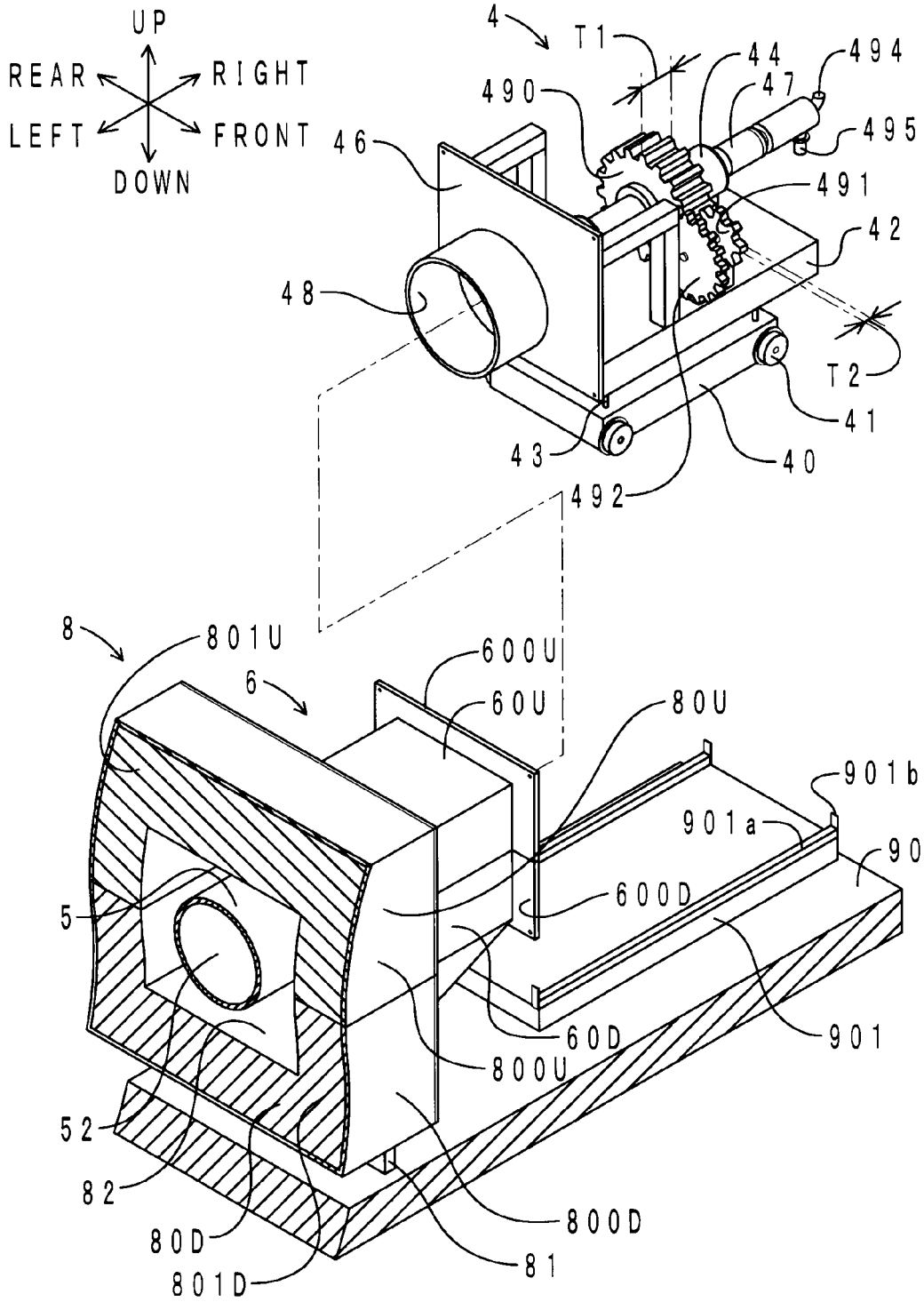
FIG. 6 is an exploded perspective view of a right portion of the rotary kiln.
Figure 7:
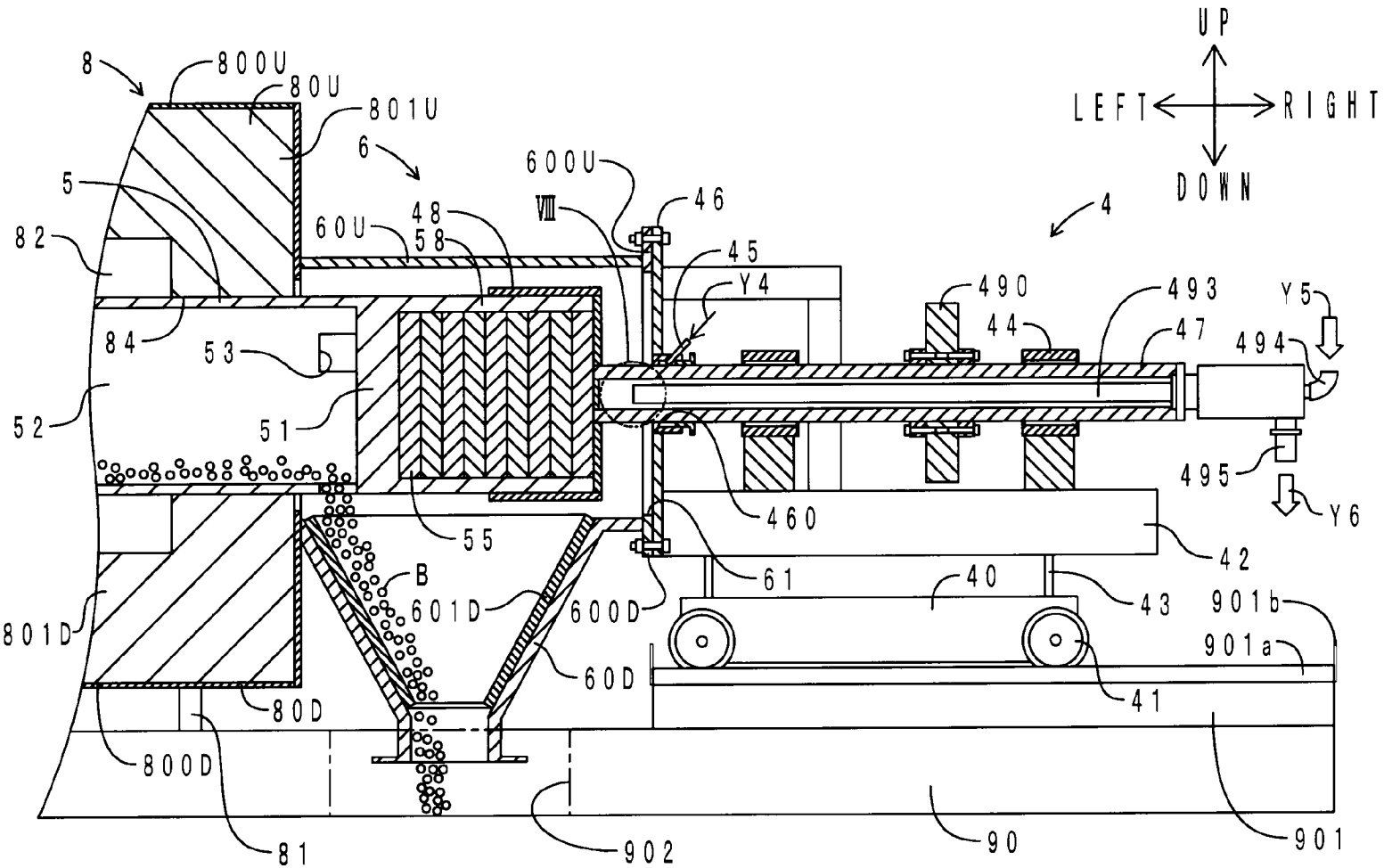
FIG. 7 is a cross-sectional view of the right portion taken in the left-right direction.

FIG. 6 is an exploded perspective view of a right portion of the rotary kiln according to the embodiment. FIG. 7 is a cross-sectional view of the right portion taken in the left-right direction. As shown in FIGS. 6 and 7, the discharge-side support cart 4 includes a lower stage portion 40, four wheels 41, an upper stage portion 42, four coupling rods 43, a pair of bearing portions 44, a sealing portion 45, a coupling plate 46, a discharge-side rotary shaft 47, a discharge-side holder 48, a discharge-side gear 490, a discharge-side pinion 491, a discharge-side sprocket 492, and a cooling pipe 493. The sealing portion 45 is included in the gas supply section according to the present invention. The cooling pipe 493 is included in the cooling section according to the present invention.

The lower stage portion 40 is made of steel, and has the shape of a rectangular plate. The four wheels 41 are disposed in the vicinity of the four corners of the lower stage portion 40. The four wheels 41 can roll in the left-right direction on the pair of rails 901*a*. That is, the discharge-side support cart 4 is movable in the left-right direction along the pair of rails 901*a*.

The upper stage portion 42 is made of steel, and has the shape of a rectangular plate. The upper stage portion 42 is disposed above the lower stage portion 40. Each of the four coupling rods 43 has the shape of a round bar. The four coupling rods 43 are interposed between the lower stage portion 40 and the upper stage portion 42.

The pair of bearing portions 44 is disposed on the upper surface of the upper stage portion 42. The pair of bearing portions 44 is arranged in the left-right direction at a predetermined interval between each other. The coupling plate 46 is made of steel, and has the shape of a rectangular plate. The coupling plate 46 is disposed at the left end of the upper stage portion 42. A discharge-side rotary shaft insertion hole 460 is drilled in the coupling plate 46. The discharge-side rotary shaft 47 is made of steel, and has the shape of a cylinder. The discharge-side rotary shaft 47 is supported by the pair of bearing portions 44 so as to be rotatable about its own axis. The left end of the discharge-side rotary shaft 47 is inserted into the discharge-side rotary shaft insertion hole 460.

The sealing portion 45 is interposed between the discharge-side rotary shaft 47 and the discharge-side rotary shaft insertion hole 460. The configuration of the sealing portion 45 is the same as the configuration of the sealing portion 35 of the supply-side support cart 3 discussed earlier (see FIG. 5). A nitrogen gas is supplied from the sealing portion 45 as indicated by an arrow Y4. The nitrogen gas is diffused inside the discharge chute 6 to be discussed later.

The discharge-side holder 48 is made of steel, and has the shape of a bottomed cylinder (cup) opening leftward. The discharge-side holder 48 is disposed on the left side of the coupling plate 46. The discharge-side holder 48 is fixed to the left end of the discharge-side rotary shaft 47.

The discharge-side gear 490 is made of steel, and has the shape of a circular plate. The discharge-side gear 490 is fixed to the outer peripheral surface of the discharge-side rotary shaft 47. The discharge-side gear 490 is disposed between the pair of bearing portions 44. The discharge-side pinion 491 is made of steel, and has the shape of a circular plate. The discharge-side pinion 491 is meshed with the discharge-side gear 490. A thickness T1 of the discharge-side gear 490 is larger than a thickness T2 of the discharge-side pinion 491. Therefore, the discharge-side pinion 491 and the discharge-side gear 490 can be meshed with each other even if the discharge-side gear 490 is displaced with respect to the discharge-side pinion 491 in the left-right direction. The discharge-side sprocket 492 is made of steel, and has the shape of a circular plate. The discharge-side sprocket 492 and the discharge-side pinion 491 are fixed to an identical shaft. As indicated by dash-dotted lines in FIG. 1, a chain 915 is wound between the discharge-side sprocket 492 and the discharge-side drive sprocket 913.

Figure 8:
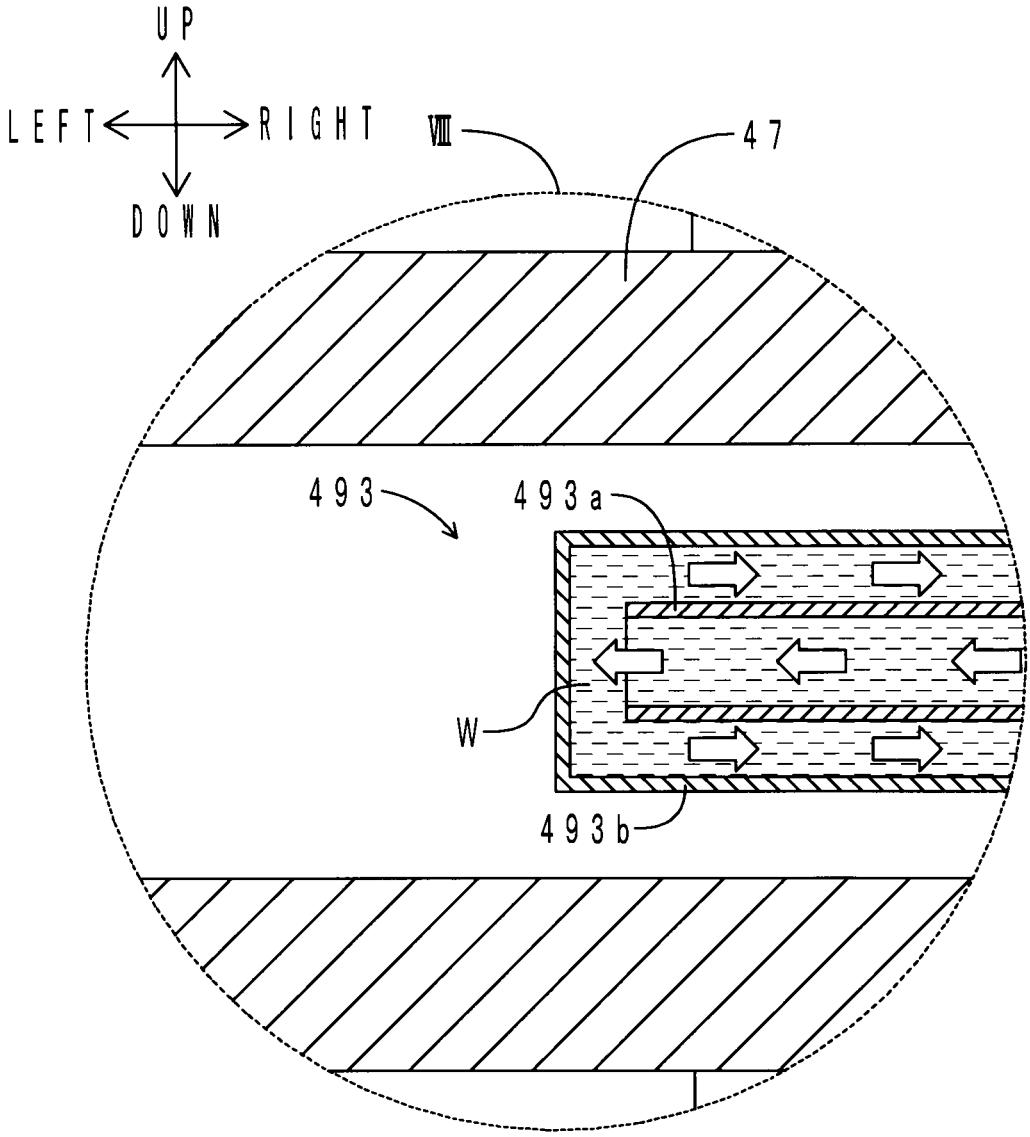
FIG. 8 is an enlarged view of a portion inside a circle VIII of FIG. 7.

FIG. 8 is an enlarged view of a portion inside a circle VIII of FIG. 7. The cooling pipe 493 is shown in cross section. As shown in FIG. 8, the cooling pipe 493 has the shape of a double cylinder, the left end of which is sealed. That is, the cooling pipe 493 includes an inner cylindrical portion 493*a* and an outer cylindrical portion 493*b*. Cooling water W is supplied from a water supply pipe 494 to the inner cylindrical portion 493*a* as indicated by an arrow Y5 in FIG. 7. The cooling water W flows leftward through a space radially inward of the inner cylindrical portion 493*a*, and turns backward at the left end of the cooling pipe 493. The cooling water W which has turned backward flows from the inner cylindrical portion 493*a* into the outer cylindrical portion 493*b*. The cooling water W having flowed into the outer cylindrical portion 493*b* flows rightward through a gap between the outer cylindrical portion 493*b* and the inner cylindrical portion 493*a*, and is discharged from a water discharge pipe 495 to the outside as indicated by an arrow Y6 in FIG. 7. The discharge-side rotary shaft 47, the pair of bearing portions 44, the discharge-side gear 490, the sealing portion 45, and so forth can be cooled by the cooling water W.

[Heating Section 8]

Figure 9:
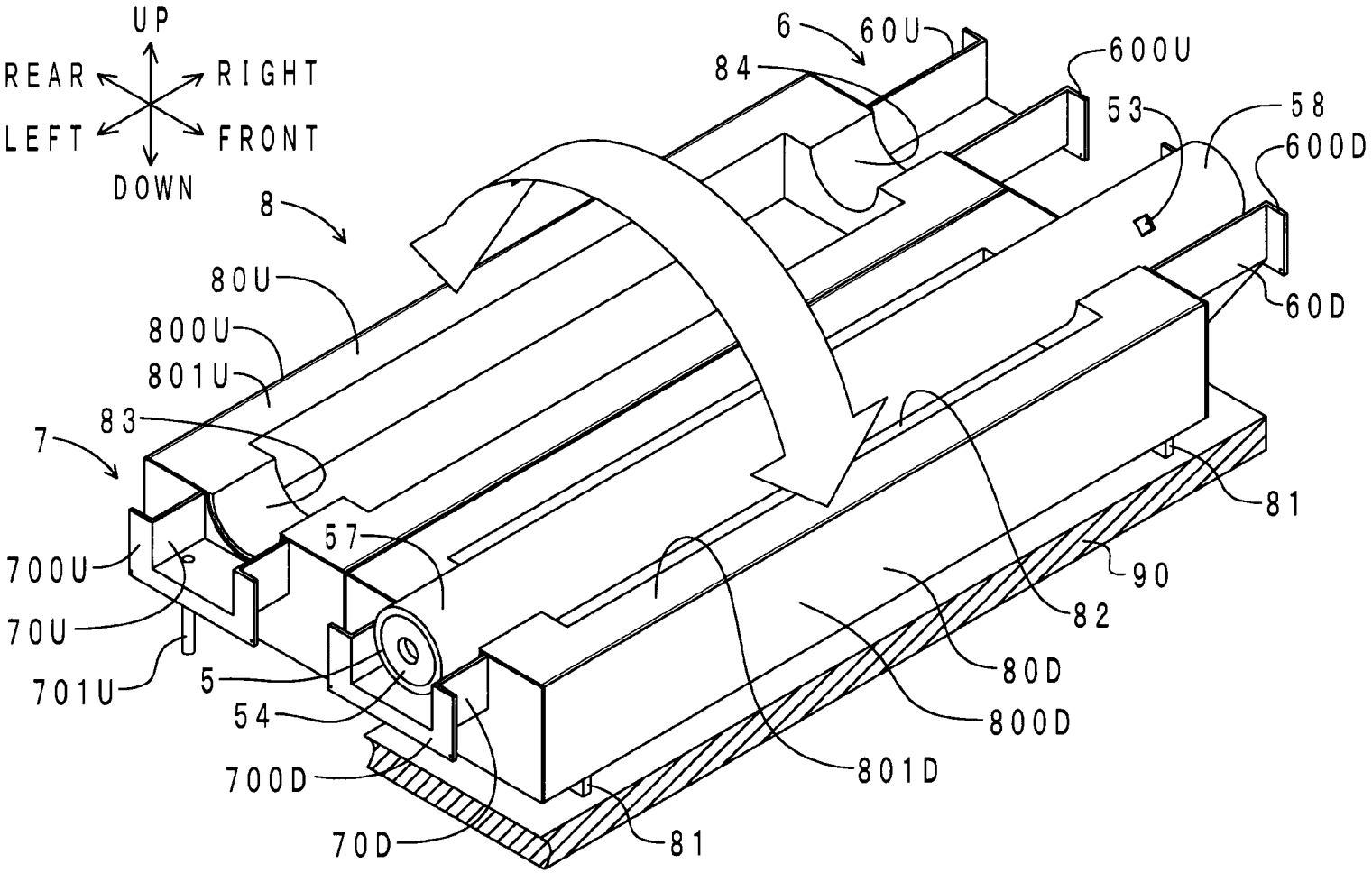
FIG. 9 is a perspective view of a center portion of the rotary kiln.

FIG. 9 is a perspective view of a center portion of the rotary kiln according to the embodiment. FIG. 9 shows an open state. As shown in FIG. 9, the heating section 8 includes a lower divided portion 80D and an upper divided portion 80U.

The lower divided portion 80D includes an outer shell 800D and a heat insulation material 801D. The outer shell 800D is made of steel, and has the shape of a rectangular box opening upward. The outer shell 800D is fixed to the upper surface of the platform 90 via a pair of support blocks 81. The heat insulation material 801D is made of a ceramic fiber or a heat insulation brick with a predetermined thickness, and is fixed to the inner surface of the outer shell 800D.

The upper divided portion 80U includes an outer shell 800U and a heat insulation material 801U. The configuration of the upper divided portion 80U is the same as the configuration of the lower divided portion 80D. The upper divided portion 80U and the lower divided portion 80D are coupled to each other via a hinge portion (not shown). The upper divided portion 80U can be opened and closed to the lower divided portion 80D. As shown in FIG. 9, in the open state, the upper divided portion 80U is disposed in rear of the lower divided portion 80D such that they are arranged side by side. Meanwhile, as shown in FIGS. 4 and 7, in a closed state, the upper divided portion 80U is disposed oppositely above the lower divided portion 80D. In the closed state, a heating chamber 82 is defined by the heat insulation materials 801D and 801U. A heater (not shown) is disposed in the heating chamber 82. Also, in the closed state, as shown in FIGS. 4 and 9, a supply-side shell insertion hole 83 is formed between an outer left portion of the heating section 8 and the heating chamber 82. In addition, as shown in FIGS. 7 and 9, a discharge-side shell insertion hole 84 is formed between an outer right portion of the heating section 8 and the heating chamber 82.

[Shell 5]

The shell 5 is made of carbon, and has the shape of a cylinder. The shell 5 penetrates through the heating section 8 in the left-right direction. That is, the left end of the shell 5 projects from the supply-side shell insertion hole 83 to the outside. Also, the right end of the shell 5 projects from the discharge-side shell insertion hole 84 to the outside. The body portion of the shell 5 is housed in the heating chamber 82. The shell 5 is slightly inclined downward from the left to the right.

Figure 10:
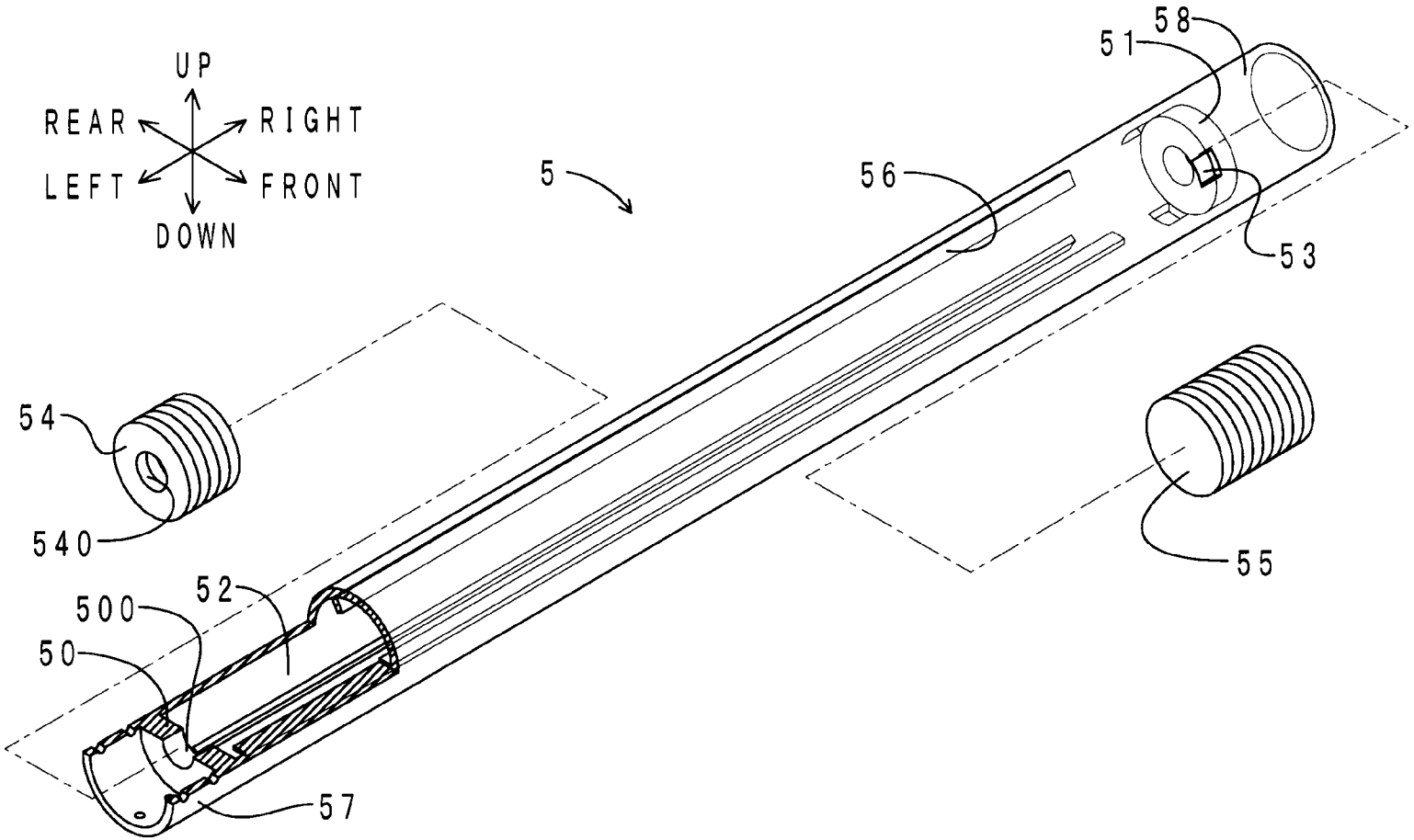
FIG. 10 is a transparent exploded perspective view of a shell of the rotary kiln.

FIG. 10 is a transparent exploded perspective view of the shell of the rotary kiln according to the embodiment. As shown in FIG. 10, the shell 5 includes a supply-side partition wall 50, a discharge-side partition wall 51, a heat treatment chamber 52, three discharge holes 53, five supply-side heat insulation plates 54, nine discharge-side heat insulation plates 55, the three fins 56, a supply-side end portion 57, and a discharge-side end portion 58. The supply-side heat insulation plates 54 are included in the supply-side heat insulation portion according to the present invention. The discharge-side heat insulation plates 55 are included in the discharge-side heat insulation portion according to the present invention.

The supply-side partition wall 50 has the shape of a circular plate. The supply-side partition wall 50 is disposed in the vicinity of the left end of the shell 5. A supply-side rotary shaft insertion hole 500 is drilled in the supply-side partition wall 50. The discharge-side partition wall 51 has the shape of a circular plate. The discharge-side partition wall 51 is disposed in the vicinity of the right end of the shell 5. The supply-side end portion 57 is disposed on the left side of the supply-side partition wall 50. The discharge-side end portion 58 is disposed on the right side of the discharge-side partition wall 51.

The heat treatment chamber 52 is defined between the supply-side partition wall 50 and the discharge-side partition wall 51. As shown in FIGS. 4 and 7, the heat treatment chamber 52 is disposed radially inward of the heating chamber 82. Returning to FIG. 10, the discharge holes 53 are disposed on the left side of the discharge-side partition wall 51. The discharge holes 53 are in communication with the heat treatment chamber 52. The three discharge holes 53 are disposed at intervals of 120° in the circumferential direction of the shell 5.

The supply-side heat insulation plates 54 are made of a ceramic fiber or a ceramic board, and have the shape of a circular plate. A supply-side rotary shaft insertion hole 540 is drilled in each of the supply-side heat insulation plates 54. The five supply-side heat insulation plates 54 are disposed in a stacked state on the left side of the supply-side partition wall 50. That is, the five supply-side heat insulation plates 54 are housed inside the supply-side end portion 57. The discharge-side heat insulation plates 55 are made of a ceramic fiber or a ceramic board, and have the shape of a circular plate. The nine discharge-side heat insulation plates 55 are disposed in a stacked state on the right side of the discharge-side partition wall 51. That is, the nine discharge-side heat insulation plates 55 are housed inside the discharge-side end portion 58.

The fins 56 have the shape of a rib. The fins 56 are disposed on the inner peripheral surface of the shell 5. The fins 56 are disposed between the supply-side partition wall 50 and the three discharge holes 53. The three fins 56 are disposed at intervals of 120° in the circumferential direction of the shell 5.

As shown in FIG. 4, the left end of the shell 5 is housed in the supply-side holder 38. The supply-side end portion 57 of the shell 5 and the supply-side holder 38 are bolted to each other. The supply-side rotary shaft 37 penetrates through the supply-side rotary shaft insertion holes 540 and 500 of the shell 5 from the left side. That is, the supply-side rotary shaft 37 penetrates through the supply-side end portion 57 from the left side. The opening at the penetrating end of the supply-side rotary shaft 37 is in communication with the heat treatment chamber 52.

As shown in FIG. 7, the right end of the shell 5 is housed in the discharge-side holder 48. The shell 5 and the discharge-side holder 48 are not fixed to each other. Therefore, the shell 5 is movable with respect to the discharge-side holder 48 in the left-right direction and in the circumferential direction.

[Supply-Side Coupling Tubular Portion 7]

As shown in FIG. 9, the supply-side coupling tubular portion 7 includes a lower divided portion 70D and an upper divided portion 70U. The lower divided portion 70D is made of steel, and has the shape of a semi-rectangular cylinder opening upward. The lower divided portion 70D is disposed at the left end of the lower divided portion 80D of the heating section 8. A flange divided portion 700D is disposed at the left end of the lower divided portion 70D.

The upper divided portion 70U is made of steel, and has the shape of a semi-rectangular cylinder opening upward in an open state. The upper divided portion 70U is disposed at the left end of the upper divided portion 80U of the heating section 8. A flange divided portion 700U is disposed at the left end of the upper divided portion 70U. A gas pipe 701U is projected from the bottom wall of the upper divided portion 70U in the open state. The gas pipe 701U is included in the gas supply section according to the present invention.

The upper divided portion 70U can be opened and closed to the lower divided portion 70D. As shown in FIG. 9, in the open state, the upper divided portion 70U is disposed in rear of the lower divided portion 70D such that they are arranged side by side. Meanwhile, as shown in FIG. 4, in a closed state, the upper divided portion 70U is disposed oppositely above the lower divided portion 70D. In the closed state, the flange divided portions 700D and 700U are joined together to form a supply-side holder insertion hole 71. The flange divided portions 700D and 700U are coupled to the coupling plate 36 of the supply-side support cart 3 via a bolt-nut mechanism. In the closed state, the left end of the shell 5 is housed inside the supply-side coupling tubular portion 7. A nitrogen gas is supplied from the gas pipe 701U into the supply-side coupling tubular portion 7 as indicated by an arrow Y7. The nitrogen gas is diffused inside the heating chamber 82 via the supply-side shell insertion hole 83.

[Discharge Chute 6]

As shown in FIG. 9, the discharge chute 6 includes a lower divided portion 60D and an upper divided portion 60U. The lower divided portion 60D is made of steel, and has the shape of a pyramid tapered downward. The lower divided portion 60D is disposed at the right end of the lower divided portion 80D of the heating section 8. A flange divided portion 600D is disposed at the right end of the lower divided portion 60D. As shown in FIG. 7, the lower end of the lower divided portion 60D is housed in the product extraction hole 902. A protection plate 601D made of carbon is disposed on the inner surface of the tapered portion of the lower divided portion 60D.

Returning to FIG. 9, the upper divided portion 60U is made of steel, and has the shape of a semi-rectangular cylinder opening upward in an open state. The upper divided portion 60U is disposed at the right end of the upper divided portion 80U of the heating section 8. A flange divided portion 600U is disposed at the right end of the upper divided portion 60U.

The upper divided portion 60U can be opened and closed to the lower divided portion 60D. As shown in FIG. 9, in the open state, the upper divided portion 60U is disposed in rear of the lower divided portion 60D such that they are arranged side by side. Meanwhile, as shown in FIG. 7, in a closed state, the upper divided portion 60U is disposed oppositely above the lower divided portion 60D. In the closed state, the flange divided portions 600D and 600U are joined together to form a discharge-side holder insertion hole 61. The flange divided portions 600D and 600U are coupled to the coupling plate 46 of the discharge-side support cart 4 via a bolt-nut mechanism. In the closed state, the right end of the shell 5 is housed inside the discharge chute 6.

<Motion During Manufacture of Battery Material>

Next, the motion of the rotary kiln according to the embodiment during manufacture of a battery material will be described. The battery material is included in the "product" according to the present invention. First, as shown in FIG. 1, the motor 910 is driven. The drive force of the motor 910 is transmitted to the supply-side gear 390 via the shaft 911, the supply-side drive sprocket 912, the chain 914, the supply-side sprocket 392, and the supply-side pinion 391 in this order. In addition, the drive force of the motor 910 is transmitted to the discharge-side gear 490 via the shaft 911, the discharge-side drive sprocket 913, the chain 915, the discharge-side sprocket 492, and the discharge-side pinion 491 in this order. As shown in FIG. 2, the supply-side gear 390 is fixed to the supply-side rotary shaft 37. The supply-side holder 38 is fixed to the supply-side rotary shaft 37. The left end of the shell 5 is fixed to the supply-side holder 38. Therefore, rotation of the supply-side gear 390 causes the shell 5 to rotate. Also, as shown in FIG. 2, the discharge-side gear 490 is fixed to the discharge-side rotary shaft 47. The discharge-side holder 48 is fixed to the discharge-side rotary shaft 47. Therefore, rotation of the discharge-side gear 490 causes the discharge-side holder 48 to rotate. In this way, the supply-side gear 390 causes the shell 5 to rotate about its own axis, and the discharge-side gear 490 causes the discharge-side holder 48 to rotate about its own axis.

Then, as shown in FIG. 4, the screw feeder 27 is driven. Then, the process material A is transferred from the supply hopper 29 to the heat treatment chamber 52. Subsequently, as shown in FIG. 10, the process material A is moved rightward with the three fins 56 stirring the process material A inside the rotating shell 5. The heat treatment chamber 52 is heated in a predetermined temperature pattern by the heating chamber 82. Therefore, a predetermined heat treatment can be performed on the process material A by causing the process material A to pass through the heat treatment chamber 52.

After that, as shown in FIG. 7, a battery material B which is obtained after the heat treatment is ejected from the discharge holes 53 of the rotating shell 5. The ejected battery material B slides down inside the discharge chute 6 while colliding against the protection plate 601D. The battery material B which has slid down is stored in a product housing portion (not shown) disposed below the discharge chute 6. In this way, the battery material B is manufactured by performing a heat treatment on the process material A.

During manufacture of the battery material B, as shown in FIG. 4, a nitrogen gas is supplied from the sealing portion 28 (arrow Y1) to a space radially inward of the shell 5. Also, a nitrogen gas is supplied from the sealing portion 35 (arrow Y2) to a space radially outward of the shell 5. Also, a nitrogen gas is supplied from the gas pipe 701U (arrow Y7) to a space radially outward of the shell 5. Moreover, as shown in FIG. 7, a nitrogen gas is supplied from the sealing portion 45 (arrow Y4) to a space radially outward of the shell 5. Thus, a nitrogen gas is supplied to a space radially inward of the shell 5 and a space radially outward of the shell 5 during manufacture of the battery material B. Moreover, as shown in FIG. 8, the discharge-side rotary shaft 47 is cooled by the cooling pipe 493 during manufacture of the battery material B.

<Motion During Replacement of Shell>

Figure 11:
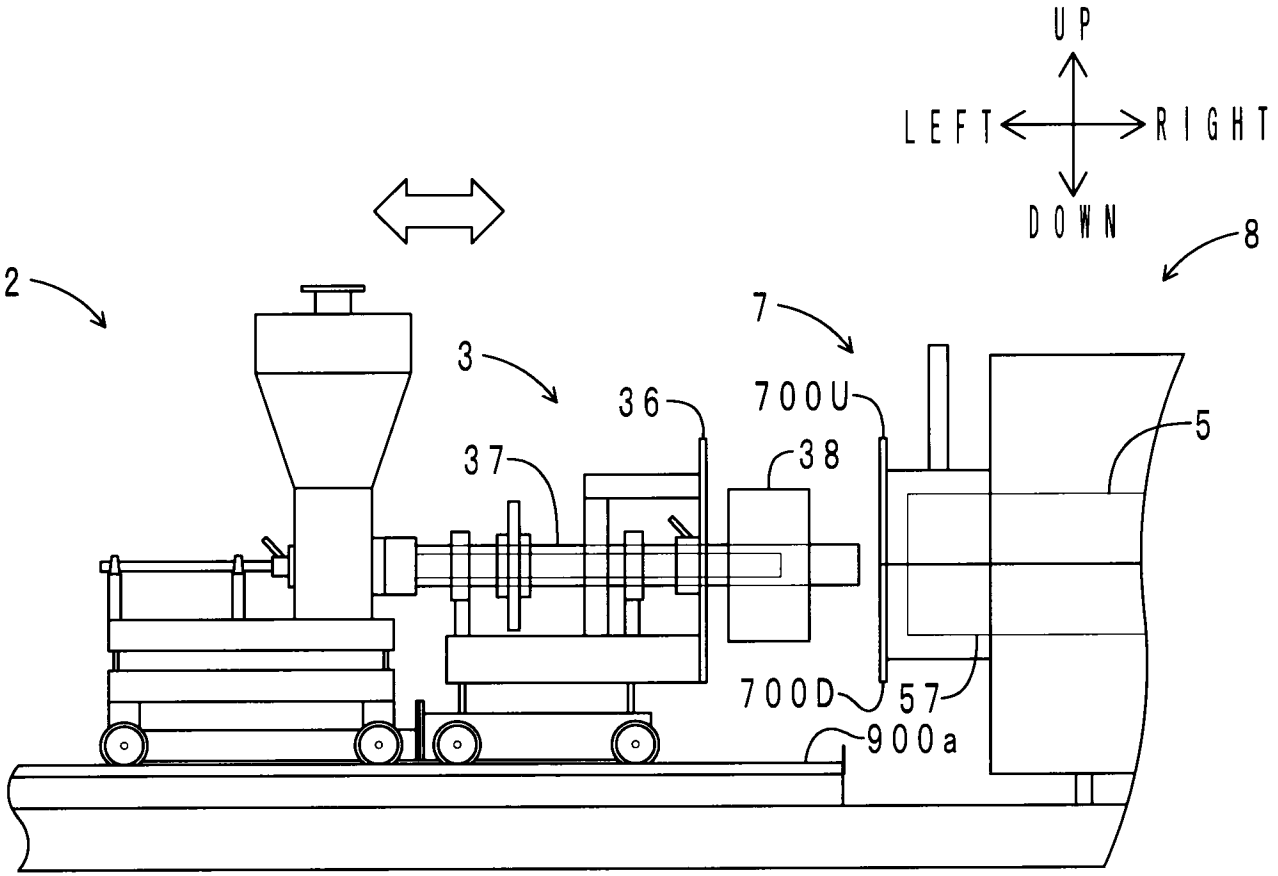
FIG. 11 is a transparent front view of the left portion of the rotary kiln during replacement of the shell.
Figure 12:
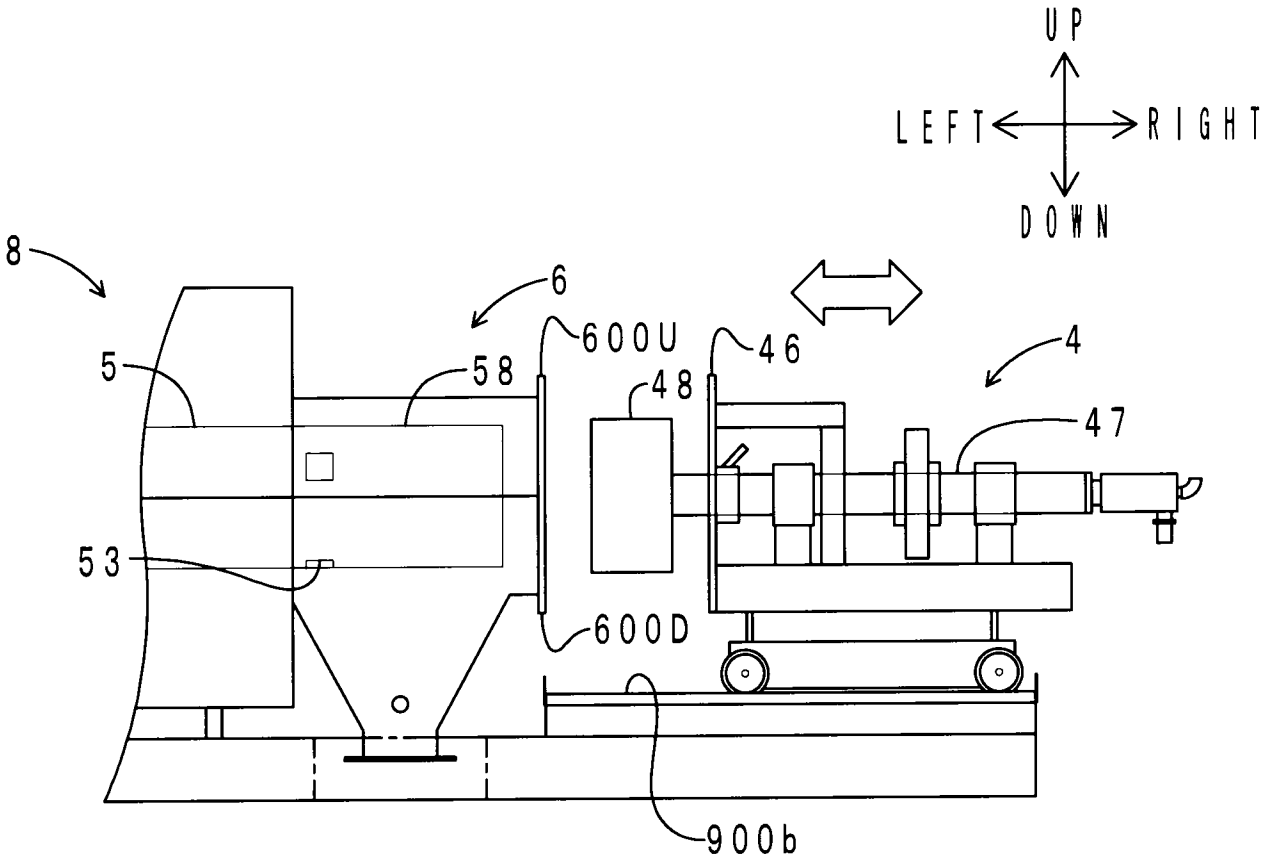
FIG. 12 is a transparent front view of the right portion of the rotary kiln during replacement of the shell.

Next, the motion of the rotary kiln according to the embodiment during replacement of the shell will be described. FIG. 11 is a transparent front view of the left portion of the rotary kiln according to the embodiment during replacement of the shell. FIG. 12 is a transparent front view of the right portion of the rotary kiln according to the embodiment during replacement of the shell.

First, as shown in FIG. 4, the nuts are removed from the bolts to decouple the coupling plate 36 of the supply-side support cart 3 and the flange divided portions 700U and 700D. Also, as shown in FIG. 7, the nuts are removed from the bolts to decouple the coupling plate 46 of the discharge-side support cart 4 and the flange divided portions 600U and 600D. Moreover, as shown in FIG. 11, the bolts are removed to decouple the supply-side end portion 57 of the shell 5 and the supply-side holder 38.

Then, the supply part cart 2 and the supply-side support cart 3 are moved leftward along the pair of rails 900*a*. Then, the supply-side rotary shaft 37 and the supply-side holder 38 are taken out of the supply-side coupling tubular portion 7. In addition, the discharge-side support cart 4 is moved rightward along the pair of rails 901*a*. Then, the discharge-side rotary shaft 47 and the discharge-side holder 48 are taken out of the discharge chute 6.

Subsequently, as shown in FIG. 9, the supply-side coupling tubular portion 7, the heating section 8, and the discharge chute 6 are brought from the closed state into the open state. Bringing the supply-side coupling tubular portion 7, the heating section 8, and the discharge chute 6 into the open state exposes the shell 5. After that, the shell 5 is removed by a jack, a winch, a crane, or the like.

Thereafter, a new shell 5 is mounted on the heating section 8, the supply-side coupling tubular portion 7, the heating section 8, and the discharge chute 6 are brought from the open state into the closed state, and the supply part cart 2, the supply-side support cart 3, and the discharge-side support cart 4 are brought back in position. Then, the bolts and the nuts are tightened. The shell 5 is thus replaced.

<Motion During Replacement of Screw Feeder>

Figure 13:
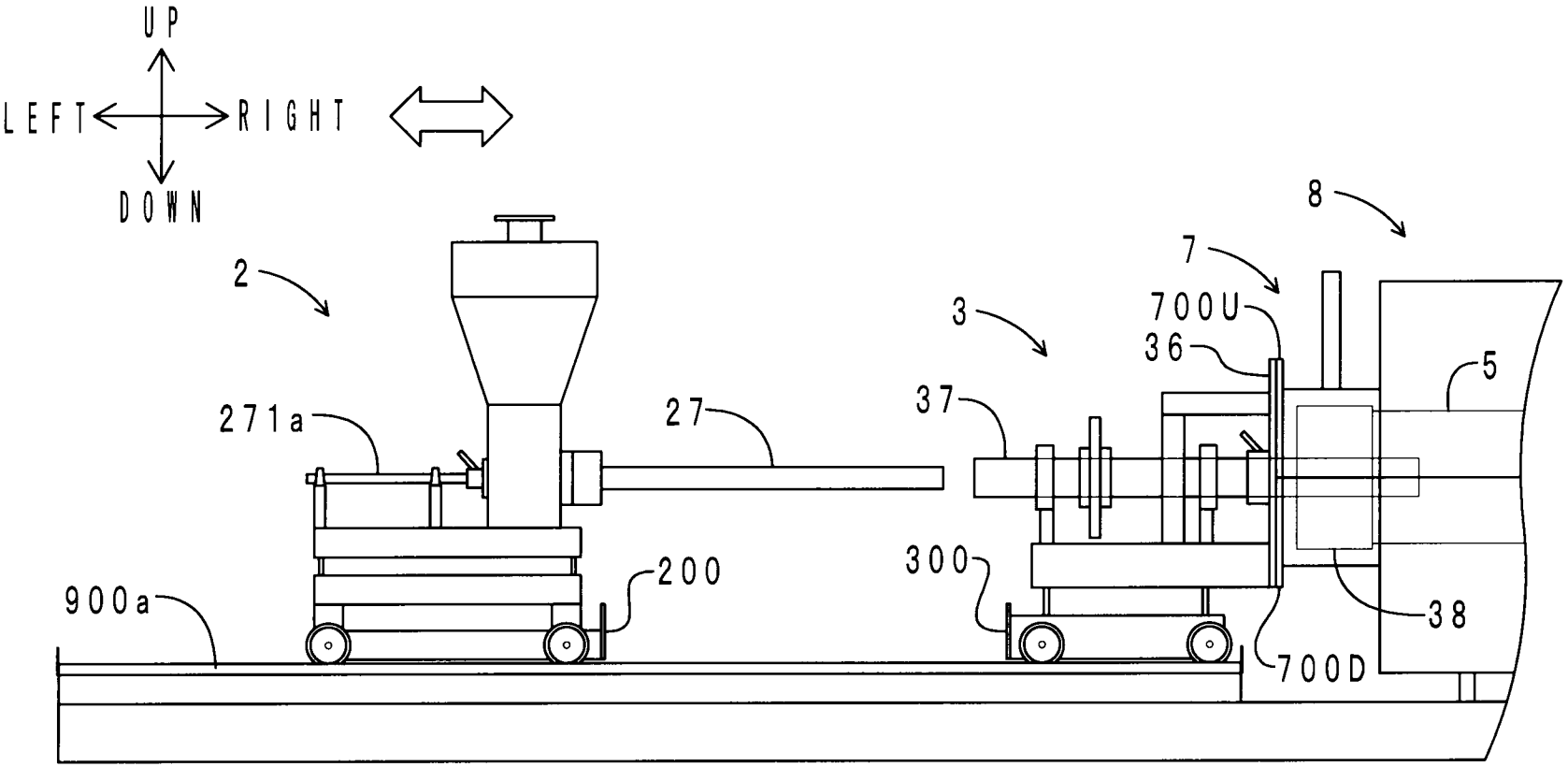
FIG. 13 is a transparent front view of the left portion of the rotary kiln during replacement of a screw feeder.

Next, the motion of the rotary kiln according to the embodiment during replacement of the screw feeder will be described. FIG. 13 is a transparent front view of the left portion of the rotary kiln according to the embodiment during replacement of the screw feeder.

First, as shown in FIG. 4, the nut is removed from the bolt to decouple the coupling plate 200 of the supply part cart 2 and the coupling plate 300 of the supply-side support cart 3. Then, the supply part cart 2 is moved leftward along the pair of rails 900*a*. Then, the screw feeder 27 is taken out of the supply-side rotary shaft 37. Subsequently, the screw feeder 27 is removed. Thereafter, a new screw feeder 27 is mounted on the supply part cart 2, and the supply part cart 2 is brought back in position. Then, the bolts and the nuts are tightened. The screw feeder 27 is thus replaced.

<Function and Effect>

Figure 14:
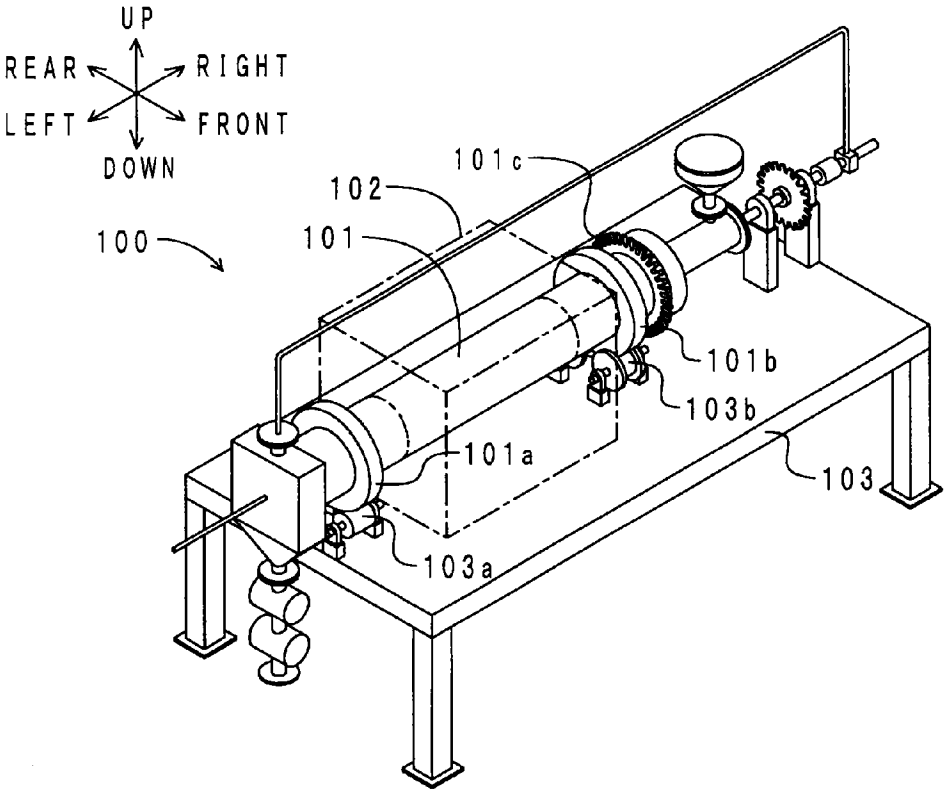
FIG. 14 PRIOR ART
FIG. 14 is a perspective view of a rotary kiln according to the related art.

Next, the function and effect of the rotary kiln and the product according to the embodiment will be described. According to the rotary kiln 1 of the embodiment, the supply-side rotary shaft 37 and the discharge-side rotary shaft 47 allow rotation of the shell 5 while securely supporting the rotation axis thereof. Also, a rotational force is transmitted to the shell 5 from the supply-side rotary shaft 37. Therefore, it is not necessary to dispose a member that allows rotation of the shell 5 while securely supporting the rotation axis thereof (for example, the tires 101*a*, 101*b* in FIG. 14) or a member that transmits a rotational force (for example, the gear 101*c* in FIG. 14) on the outer peripheral surface of the shell. Thus, the shell 5 can be rotated with the rotation axis thereof being securely supported regardless of the material of the shell 5. In addition, a rotational force can be transmitted to the shell 5 regardless of the material of the shell 5. Thus, the rotary kiln 1 according to the embodiment provides high versatility for the material of the shell 5.

Also, according to the rotary kiln 1 of the embodiment, it is only necessary to change the supply-side holder 38 and the discharge-side holder 48 in order to change the diameter of the shell 5. That is, it is not necessary to change the supply-side rotary shaft 37 and the discharge-side rotary shaft 47. Therefore, the rotary kiln 1 according to the embodiment provides high versatility for the diameter of the shell 5.

According to the rotary kiln 1 of the embodiment, the supply-side holder 38 and the discharge-side holder 48 are attached to the shell 5 so as to be removable in the left-right direction. That is, the shell 5 can be removed from the supply-side holder 38 and the discharge-side holder 48. This is convenient for inspection, repair, replacement, and so forth of the shell 5.

According to the rotary kiln 1 of the embodiment, the supply-side holder 38 and the supply-side rotary shaft 37 are disposed on the supply-side support cart 3. Also, the discharge-side holder 48 and the discharge-side rotary shaft 47 are disposed on the discharge-side support cart 4. Therefore, the supply-side holder 38 and the discharge-side holder 48 are easily movable. That is, the supply-side holder 38 and the discharge-side holder 48 can be easily attached to and removed from the shell 5.

According to the rotary kiln 1 of the embodiment, the process material A can be easily supplied into the shell 5. Moreover, the left end of the heat treatment chamber 52 can be located in the vicinity of the supply-side end portion 57. That is, the overall length of the heat treatment chamber 52 in the left-right direction can be set to be long.

According to the rotary kiln 1 of the embodiment, the screw feeder 27 is disposed on the supply part cart 2. Therefore, the screw feeder 27 is easily movable. That is, the screw feeder 27 can be easily inserted into and taken out of the supply-side rotary shaft 37. This is convenient for inspection, repair, replacement, and so forth of the screw feeder 27.

According to the rotary kiln 1 of the embodiment, the supply-side coupling tubular portion 7, the heating section 8, and the discharge chute 6 can be switched between the closed state and the open state. Therefore, a portion of the shell 5 that is housed in the supply-side coupling tubular portion 7, the heating section 8, and the discharge chute 6 can be exposed easily. This is convenient for inspection, repair, replacement, and so forth of the shell 5. This also allows access to the shell 5 from above during replacement of the shell 5. This facilitates replacement work.

According to the rotary kiln 1 of the embodiment, the supply-side heat insulation plates 54 are disposed radially inward of the supply-side end portion 57. Also, the discharge-side heat insulation plates 55 are disposed radially inward of the discharge-side end portion 58. Therefore, a failure due to heat is not likely to occur in the supply-side rotary shaft 37 and the discharge-side rotary shaft 47. Also, since heat is not easily transmitted to the supply-side rotary shaft 37 and the discharge-side rotary shaft 47, the overall length of the heat treatment chamber 52 in the left-right direction can be set to be long.

According to the rotary kiln 1 of the embodiment, the cooling pipe 493 is disposed inside the discharge-side rotary shaft 47. Therefore, the discharge-side rotary shaft 47, the pair of bearing portions 44, the discharge-side gear 490, the sealing portion 45, and so forth can be cooled using the cooling water W. Thus, a failure due to heat is not likely to occur in the discharge-side rotary shaft 47, the pair of bearing portions 44, the discharge-side gear 490, the sealing portion 45, and so forth. Also, since the temperature of the discharge-side rotary shaft 47 is not likely to rise, the overall length of the heat treatment chamber 52 in the left-right direction can be set to be long.

According to the rotary kiln 1 of the embodiment, the drive section 91 for both the supply-side rotary shaft 37 and the discharge-side rotary shaft 47 is provided. Therefore, the number of parts is reduced compared to a case where a drive section exclusively for the supply-side rotary shaft 37 and a drive section exclusively for the discharge-side rotary shaft 47 are provided separately. Also, the drive section 91 requires only a small installation space. Moreover, it is easier to match the rotational speed of the supply-side rotary shaft 37 and the rotational speed of the discharge-side rotary shaft 47 with each other.

According to the rotary kiln 1 of the embodiment, the supply-side holder 38 and the supply-side end portion 57 are bolted to each other. Therefore, the supply-side holder 38 and the supply-side end portion 57 are not rotatable relative to each other. Meanwhile, the discharge-side end portion 58 is merely housed in the discharge-side holder 48. Therefore, the discharge-side end portion 58 and the discharge-side holder 48 are rotatable relative to each other. Thus, a torsional force is not likely to be applied to the shell 5 even in the case where the rotational speed of the supply-side rotary shaft 37 and the rotational speed of the discharge-side rotary shaft 47 are different from each other.

According to the rotary kiln 1 of the embodiment, an ambient gas can be supplied in accordance with the characteristics of the process material A and the material of the shell 5. That is, the kind of the ambient gas can be changed when the process material A or the shell 5 is changed. This allows the rotary kiln 1 to be commonly used for a plurality of types of process materials A and shells 5.

The shell 5 of the rotary kiln 1 according to the embodiment is made of carbon. Therefore, contamination of metal scale, which adversely affects the battery material B, into the battery material B can be suppressed. Thus, degradation in performance of the battery material B can be suppressed. Also, the shell 5 made of carbon provides excellent processability. Therefore, as shown in FIG. 10, members such as the supply-side partition wall 50, the discharge-side partition wall 51, the discharge holes 53, and the fins 56 can be easily provided in the shell 5. These members can be provided in the shell 5 by cutting a carbon block or by bolting. Moreover, the shell 5 made of carbon provides excellent heat shock resistance.

Also, the heat treatment chamber 52 is disposed radially inward of the shell 5. Therefore, a heat treatment involves a rise in temperature of the shell 5. A rise in temperature of the shell 5 may cause oxidation of the shell 5 made of carbon.

In this respect, according to the rotary kiln 1 of the embodiment, a nitrogen gas is supplied from each of the sealing portion 28 of FIG. 4 (arrow Y1), the sealing portion 35 of FIG. 5 (arrow Y2), the gas pipe 701U of FIG. 4 (arrow Y7), and the sealing portion 45 of FIG. 7 (arrow Y4). Therefore, oxidation of the inner peripheral surface and the outer peripheral surface of the shell 5 can be suppressed.

According to the rotary kiln 1 of the embodiment, as shown in FIG. 7, the protection plate 601D made of carbon is disposed in the discharge chute 6. Therefore, contamination of metal scale into the battery material B from the lower divided portion 60D made of steel can be suppressed.

The rotary kiln 1 of the embodiment can adapt to increases and decreases in overall length of the shell 5 in the axial direction (left-right direction) due to heat of the heating section 8 or the like. That is, as shown in FIG. 5 illustrating the sealing portion 35, a slide margin in the axial direction is secured between the inner annular portion 350 and the outer annular portion 351 of the sealing portion 45. Also, as shown in FIG. 7, the pair of bearing portions 44 is each a dry metal bearing that supports the discharge-side rotary shaft 47 so as to be slidable in the axial direction. Moreover, as shown in FIG. 6, the thickness T1 of the discharge-side gear 490 is set to be larger than the thickness T2 of the discharge-side pinion 491. Therefore, the discharge-side pinion 491 and the discharge-side gear 490 can be meshed with each other even if the discharge-side gear 490 is displaced with respect to the discharge-side pinion 491 in the left-right direction. The rotary kiln 1 according to the embodiment can thus adapt to increases and decreases in overall length of the shell 5 in the axial direction.

In the case where the shell 5 has a double cylinder construction with an outer layer made of a metal and an inner layer made of carbon, the inner layer is generally bolted to the outer layer. With such a construction, a minute gap, that is, an air layer, is likely to be interposed between the inner layer and the outer layer. Therefore, heat is not easily conducted from the outer layer to the inner layer. In contrast, the shell 5 of the rotary kiln 1 according to the embodiment is a one-piece member made of carbon. Therefore, heat is easily conducted from the outer surface to the inner surface. Thus, the shell 5 provides excellent thermal conductivity.

The rotary kiln 1 according to the embodiment provides high versatility for the material of the shell 5. Therefore, the material of the shell 5 can be selected in accordance with the type of the product (in the case of the embodiment, the battery material B). Thus, it is possible to manufacture a desired product without using the shell 5 which contains a component, contamination of which into the product is not preferable.

Other Embodiments

The rotary kiln and the product according to the embodiment of the present invention have been described above. However, the present invention should not be specifically limited to the embodiment described above. The present invention can also be implemented in various modified or improved forms that may occur to those skilled in the art.

For example, the mechanism for rotating the supply-side rotary shaft 37 and the discharge-side rotary shaft 47 is not specifically limited. As shown in FIG. 2, a tire may be provided on the supply-side rotary shaft 37 and the discharge-side rotary shaft 47 and rollers may be provided on the supply-side support cart 3 and the discharge-side support cart 4 so that the supply-side rotary shaft 37 and the discharge-side rotary shaft 47 can be rotated by rolling the tire on the rollers.

The type of the ambient gas is also not specifically limited. An inert gas (such as helium and argon) or a reducing gas (such as a carbon monoxide gas) may be used. The material of the shell 5 is also not specifically limited. A metal such as Ni (nickel), SUS, and Cu (copper), a ceramic such as SiC (silicon carbide), or carbon may be used. In particular, the rotary kiln according to the present invention is suitably embodied as the rotary kiln 1 having the shell 5 made of a material, on the outer peripheral surface of which it is difficult to dispose a member (such as a tire and a gear), such as a ceramic, carbon, and silica glass, for example. The rotary kiln according to the present invention is also suitably embodied as the rotary kiln 1 having the shell 5 made of a material that is too soft to dispose a member on the outer peripheral surface, such as Cu, for example.

As the process material A, $LiFePO_4$ and carbon powder, which are respectively a cathode material and a anode material for an ferric phosphate lithium-ion battery, may be used, for example. In this case, contamination of carbon of the shell 5 into the cathode material has little effect on the cathode material, compared to a case of contamination of metal scale into the cathode material. Also, contamination of carbon of the shell 5 into the anode material has little effect on the anode material because the anode material itself is made of carbon. Meanwhile, as the product, food, waste, chemicals, chemical raw materials, ceramic raw materials, carbon materials (nano carbon), and so forth may be used, for example, as well as the battery material B. The properties of the process material A and the product are also not specifically limited. For example, the process material A and the product may be powdery, particulate, massive, liquid, or foamed. The process material A and the product may be a contamination of two or more thereof. The particle shapes of the process material A and the product may be perfectly spherical, ovally spherical, polyhedral, or needle-shaped, or may be an irregular shape obtained by appropriately incorporating these shapes.

What is claimed is:

1. A rotary kiln comprising:

a shell having a supply-side end portion and a discharge-side end portion in an axial direction of the shell, the shell comprising a heat treatment chamber which is provided inside the shell and in which a heat treatment is performed on a process material;

a supply-side holder configured to hold the supply-side end portion;

a discharge-side holder configured to hold the discharge-side end portion;

a supply-side rotary shaft connected to the supply-side holder and configured to allow rotation of the supply-side holder; and a discharge-side rotary shaft connected to the discharge-side holder and configured to allow rotation of the discharge-side holder, wherein the shell has a hole in the supply-side end portion which allows the supply-side rotary shaft to penetrate inside the supply-side end portion and to have a penetrating end of the supply-side rotary shaft extending into the heat treatment chamber, and the supply-side rotary shaft and the discharge-side rotary shaft are rotatable such that the shell is rotated about an axis of the shell by rotating at least one of the supply-side rotary shaft and the discharge-side rotary shaft.

2. The rotary kiln according to claim 1, wherein the supply-side holder and the discharge-side holder are attached to the shell such that the supply-side holder and the discharge-side holder are removable in the axial direction.

3. The rotary kiln according to claim 2, further comprising:

a supply-side support cart that includes the supply-side holder, the supply-side rotary shaft, and a bearing portion which rotatably supports the supply-side rotary shaft; and a discharge-side support cart that includes the discharge-side holder, the discharge-side rotary shaft, and a bearing portion which rotatably supports the discharge-side rotary shaft, wherein the supply-side support cart and the discharge-side support cart are movable in the axial direction.

4. The rotary kiln according to claim 3, further comprising:

a supply part cart that includes a supply section connected to the supply-side rotary shaft and configured to supply the process material into the heat treatment chamber through the supply-side rotary shaft inserted into the shell from the supply-side end portion, wherein the supply part cart is movable in the axial direction such that the supply section is detachable from the supply-side rotary shaft.

5. The rotary kiln according to claim 2, further comprising:

a heating section that includes a heating chamber provided inside the heating section, wherein the shell penetrates through the heating chamber, and the heating section is dividable along the shell.

6. The rotary kiln according to claim 1, wherein the shell includes a supply-side heat insulation portion disposed radially inward of the supply-side end portion and a discharge-side heat insulation portion disposed radially inward of the discharge-side end portion.

7. The rotary kiln according to claim 1, further comprising:

a cooling section disposed inside the discharge-side rotary shaft to cool the discharge-side rotary shaft.

8. The rotary kiln according to claim 1, further comprising:

a drive section configured to transmit a drive force to the supply-side rotary shaft and the discharge-side rotary shaft.

9. The rotary kiln according to claim 1, wherein the supply-side holder and the supply-side end portion form a first set, the discharge-side holder and the discharge-side end portion form a second set, one of the first set and the second set is coupled to each other not to be rotatable relative to each other, and the other of the first set and the second set is coupled to be rotatable relative to each other.

10. The rotary kiln according to claim 1, further comprising:

a gas supply section configured to supply an ambient gas to a space radially inward of the shell and a space radially outward of the shell.

11. The rotary kiln according to claim 1, wherein the shell is made of carbon, and a battery material is manufactured by performing a heat treatment on the process material.

12. A product manufactured by performing a heat treatment on the process material in the rotary kiln according to claim 1.

13. The rotary kiln according to claim 1, wherein at least one of the supply-side holder and the discharge-side holder comprises steel, and the shell comprises carbon.

14. The rotary kiln according to claim 13, wherein the supply-side holder and the discharge-side holder are made of steel, and the shell is made of carbon.

15. The rotary kiln according to claim 1, wherein at least one of the supply-side rotary shaft and the discharge-side rotary shaft comprises steel, and the shell comprises carbon.

16. The rotary kiln according to claim 15, wherein the supply-side rotary shaft and the discharge-side rotary shaft are made of steel, and the shell is made of carbon.

17. The rotary kiln according to claim 1, further comprising a coupling plate on which the supply-side holder is disposed.

18. The rotary kiln according to claim 1, further comprising a supply-side coupling tubular portion configured to house the shell, wherein the supply-side coupling tubular portion has a supply-side holder insertion hole in which the supply-side holder is detachably connected to the supply-side end portion of the shell.

19. The rotary kiln according to claim 18, wherein the supply-side coupling tubular portion has a gas pipe such that the gas is supplied from the gas pipe to a space radially outward of the shell.

20. A rotary kiln comprising:

a shell having a cylindrical form and having a supply-side end portion and a discharge-side end portion in an axial direction of the shell, the shell comprising a heat treatment chamber which is formed inside the shell and in which a heat treatment is performed on a process material;

a supply-side holder configured to hold the supply-side end portion;

a discharge-side holder configured to hold the discharge-side end portion;

a supply-side rotary shaft connected to the supply-side holder such that the supply-side holder is rotatable; and a discharge-side rotary shaft connected to the discharge-side holder such that the discharge-side holder is rotatable, wherein the shell includes a supply-side heat insulation portion in the supply-side end portion and has a hole which receives the supply-side rotary shaft such that a portion of the supply-side rotary shaft reaches inside the supply-side heat insulation portion, and the supply-side rotary shaft and the discharge-side rotary shaft are rotatable such that the shell is rotated about an axis of the shell by rotating at least one of the supply-side rotary shaft and the discharge-side rotary shaft.

* * * * *